US010201226B2

(12) United States Patent
Burnett et al.

(10) Patent No.: US 10,201,226 B2
(45) **Date of Patent: *Feb. 12, 2019**

(54) CONSTRUCTION SYSTEM AND METHOD AND RELATED ARTICLES

(71) Applicant: Sauder Woodworking Co., Archbold, OH (US)

(72) Inventors: Marvin K. Burnett, Archbold, OH (US); Mark A. Strayer, Lamar, MO (US); Neal J. Fifer, McClure, OH (US)

(73) Assignee: SAUDER WOODWORKING CO., Archbold, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/657,390

(22) Filed: Jul. 24, 2017

(65) Prior Publication Data

US 2018/0199707 A1 Jul. 19, 2018

Related U.S. Application Data

(63) Continuation-in-part of application No. 15/407,921, filed on Jan. 17, 2017, now Pat. No. 10,034,543.

(51) Int. Cl.
*A47F 5/11* (2006.01)
*A47B 43/02* (2006.01)
(Continued)

(52) U.S. Cl.
CPC ..... *A47B 47/0083* (2013.01); *A47B 43/02* (2013.01); *A47B 47/0091* (2013.01);
(Continued)

(58) Field of Classification Search
CPC ..... A47B 47/06; A47B 43/02; A47B 47/042; A47B 55/06; A47B 61/06; A47B 96/021;
(Continued)

(56) References Cited

U.S. PATENT DOCUMENTS 2,144,318 A * 1/1939 Kryder ..... B65D 1/225 160/231.2
2,149,882 A * 3/1939 Macmillan ..... B21D 53/74 217/2

(Continued)

FOREIGN PATENT DOCUMENTS

CA 2367533 A1 7/2002

OTHER PUBLICATIONS

Sauder Item #401281 documentation, including: instruction book dated Jun. 16, 2006; part drawings dated Nov. 21 and 24, 2005; and miter-fold specification dated Jan. 18, 2006, 51 pages.

(Continued)

*Primary Examiner* — Jennifer E. Novosad

(74) *Attorney, Agent, or Firm* — Honigman Miller Schwartz and Cohn LLP

(57) ABSTRACT

A furniture unit includes at least one substrate having an upper surface, a lower surface, a proximal peripheral surface, a distal peripheral surface, a first seam, and a second seam. The lower surface is opposite the upper surface. The proximal peripheral surface extends from the upper surface to the lower surface. The distal peripheral surface is opposite the proximal peripheral surface and extends from the upper surface to the lower surface. The second seam is spaced apart from the first seam. The first and second seams extend in a direction parallel to the proximal peripheral surface. The proximal peripheral surface engages the lower surface such that the substrate defines a first hollow support.

23 Claims, 11 Drawing Sheets

(51) Int. Cl.

| | |
|---|---|
| ***A47B 47/00*** | (2006.01) |
| ***A47B 47/06*** | (2006.01) |
| ***A47B 55/06*** | (2006.01) |
| ***A47B 87/02*** | (2006.01) |

(52) U.S. Cl.

CPC ..... *A47B 47/06* (2013.01); *A47B 55/06* (2013.01); *A47B 87/0207* (2013.01); *A47F 5/112* (2013.01); *A47B 2230/0029* (2013.01); *A47B 2230/0055* (2013.01); *A47B 2230/0059* (2013.01); *A47B 2230/0085* (2013.01); *Y10T 156/1051* (2015.01); *Y10T 156/1056* (2015.01)

(58) Field of Classification Search

CPC ..... A47B 96/02; A47B 43/00; A47B 57/58; A47B 57/588; A47B 96/04; A47B 47/0091; A47B 87/00; A47B 87/007; A47B 87/02; A47B 87/0207; A47B 87/0215; A47B 2230/0029; A47B 2230/0033; A47B 2230/004; A47B 2230/0044; A47B 2230/0048; A47B 2230/0051; A47B 2230/0055; A47B 2230/0059; A47B 2230/0062; A47B 2230/0074; A47B 2230/0077; A47B 2230/0081; A47B 2230/0085; A47B 2230/0092; A47B 2230/05; A47B 47/0083; A47F 5/11; A47F 5/112; A47F 5/114; A47F 5/116; A47F 5/118; A47F 5/0018; A47F 5/0025; A47F 7/0028; A47F 5/005; A47F 7/144; A47F 5/132; A47F 5/10; A47F 5/108; B65D 5/005; B65D 5/504; B65D 1/36; B65D 5/0015; B65D 5/2038; B65D 5/22; B65D 5/48044; B65D 5/48024; Y10T 156/1064; Y10T 156/1051; Y10T 156/1056

USPC ..... 211/72, 195, 153, 188, 194, 135, 73, 211/70.1, 126.16, 149; 248/174; 206/558, 561, 509; 229/120.06, 120.33, 229/120.34, 120.26, 120.02, 120.24, 229/120.29, 178, 915; 156/257, 227

See application file for complete search history.

(56) References Cited

U.S. PATENT DOCUMENTS

| | | | | | |
|---|---|---|---|---|---|
| 2,768,043 | A * | 10/1956 | Kristoff | B60N 3/002 | 108/10 |
| 2,993,603 | A * | 7/1961 | Fohn | A47B 96/028 | 108/152 |
| 3,638,803 | A | 2/1972 | MacMillan | | |
| 3,648,626 | A * | 3/1972 | Schuster | A47B 45/00 | 108/42 |
| 3,649,398 | A * | 3/1972 | Keith | B29C 53/063 | 138/149 |
| 3,675,808 | A * | 7/1972 | Brink | B65D 1/225 | 206/509 |
| 3,698,329 | A * | 10/1972 | Diamond | A47B 96/06 | 108/42 |
| 3,729,244 | A * | 4/1973 | Butler | A47B 3/12 | 108/115 |
| 3,863,575 | A * | 2/1975 | Kuns | A47B 43/02 | 108/179 |
| 3,881,794 | A * | 5/1975 | Henning | A47B 96/202 | 217/65 |
| 3,952,672 | A * | 4/1976 | Gordon | B65D 19/0012 | 108/51.3 |
| 4,099,472 | A | 7/1978 | Kellogg | | |
| 4,325,597 | A * | 4/1982 | Morrison | A47B 47/04 | 108/61 |
| 4,402,170 | A * | 9/1983 | Seidner | E06B 1/32 | 52/631 |
| 4,709,642 | A * | 12/1987 | Briosi | F16B 12/32 | 108/187 |
| 4,759,295 | A * | 7/1988 | Nilsen | B65D 19/0016 | 108/51.3 |
| 4,792,325 | A | 12/1988 | Schmidtke | | |
| 4,867,074 | A | 9/1989 | Quasnick | | |
| 4,930,643 | A | 6/1990 | Flum | | |
| 5,100,090 | A * | 3/1992 | Drower | A47B 96/027 | 108/152 |
| 5,176,090 | A | 1/1993 | Roberts et al. | | |
| 5,195,440 | A | 3/1993 | Gottlieb | | |
| 5,272,989 | A * | 12/1993 | Johnston | B65D 19/0026 | 108/51.3 |
| 5,339,746 | A * | 8/1994 | Vannatta | B65D 19/0012 | 108/51.3 |
| 5,377,600 | A | 1/1995 | Speese et al. | | |
| 5,411,153 | A | 5/1995 | Unfried | | |
| 5,413,834 | A * | 5/1995 | Hunter | A47B 96/202 | 428/121 |
| 5,441,154 | A | 8/1995 | Youell, III | | |
| 5,562,048 | A * | 10/1996 | Gottlieb | B65D 19/0012 | 108/51.3 |
| 5,682,936 | A * | 11/1997 | Higdon, Jr. | A47B 88/9412 | 144/345 |
| 5,735,221 | A * | 4/1998 | Benayon | A47B 47/024 | 108/107 |
| 5,809,903 | A * | 9/1998 | Young, Jr. | B65D 19/0026 | 108/51.3 |
| 5,921,187 | A * | 7/1999 | Wang | B65D 19/0016 | 108/51.3 |
| 5,950,546 | A * | 9/1999 | Brown | B65D 19/0012 | 108/56.1 |
| 5,996,510 | A * | 12/1999 | Harpman | B65D 19/0012 | 108/51.3 |
| 6,050,428 | A * | 4/2000 | Hollander | A47B 96/021 | 211/135 |
| 6,135,033 | A * | 10/2000 | Deferrari | A47F 5/116 | 108/165 |
| 6,520,353 | B2 * | 2/2003 | Fulbright | A47B 96/028 | 108/108 |
| 7,028,964 | B2 * | 4/2006 | Baechle | A47B 91/005 | 206/320 |
| 7,223,317 | B2 | 5/2007 | Newberry et al. | | |
| 7,325,500 | B2 * | 2/2008 | Carpenter | B65D 19/06 | 108/51.11 |
| 7,744,160 | B2 * | 6/2010 | Stolarov | A47B 96/202 | 108/157.14 |
| 7,891,507 | B2 * | 2/2011 | Shetler | A47B 55/00 | 211/135 |
| 8,857,351 | B2 * | 10/2014 | Zimmer | A47B 47/04 | 108/157.16 |
| 9,185,984 | B2 * | 11/2015 | Henke | A47B 47/0008 | |
| 2006/0165248 | A1 | 7/2006 | Butcher et al. | | |
| 2014/0291262 | A1 * | 10/2014 | Choe | B32B 38/0012 | 211/42 |
| 2015/0305521 | A1 * | 10/2015 | Volz | A47F 5/118 | 211/135 |
| 2016/0088941 | A1 * | 3/2016 | Snowbarger | A47B 96/021 | 211/135 |
| 2016/0198870 | A1 * | 7/2016 | Volz | A47F 5/116 | 211/135 |

OTHER PUBLICATIONS

Photos of birdhouse, publicly available prior to Jan. 17, 2016, 3 pages.

Mainstays Parsons End Table, believed to be publicly available before Jan. 17, 2017, 4 pages.

* cited by examiner

CONSTRUCTION SYSTEM AND METHOD AND RELATED ARTICLES

CROSS REFERENCE TO RELATED APPLICATIONS

This U.S. patent application is a continuation-in-part of, and claims priority under 35 U.S.C. § 120 from, U.S. patent application Ser. No. 15/407,921, filed on Jan. 17, 2017. The disclosure of this prior application is considered part of the disclosure of this application and is hereby incorporated by reference in its entirety.

FIELD

The present disclosure relates to a system and method for constructing an article, and more particularly to articles having a folded construct.

BACKGROUND

This section provides background information related to the present disclosure and is not necessarily prior art.

Laminated substrates are often used to manufacture various types of furniture and fixtures for homes and offices. For example, countertops, drawer boxes, speaker boxes, and other items are often manufactured from wood, or a wood composite, having a polymer laminate.

While known systems and methods for constructing articles such as bed rails and ceiling panels have proven useful for their intended purposes, a need for continuous improvement in the pertinent art remains.

SUMMARY

This section provides a general summary of the disclosure, and is not a comprehensive disclosure of its full scope or all of its features.

One aspect of the disclosure provides a furniture unit. The furniture unit may include at least one substrate having an upper surface, a lower surface, a proximal peripheral surface, a distal peripheral surface, a first seam, and a second seam. The lower surface may be opposite the upper surface. The proximal peripheral surface may extend from the upper surface to the lower surface. The distal peripheral surface may be opposite the proximal peripheral surface and extend from the upper surface to the lower surface. The second seam may be spaced apart from the first seam. The first and second seams may extend in a direction parallel to the proximal peripheral surface. The proximal peripheral surface may engage the lower surface such that the substrate defines a first hollow support.

This aspect may include one or more of the following optional features. In some implementations, the upper surface engages the lower surface.

In some implementations, the distal peripheral surface is aligned with a portion of the upper surface. The distal peripheral surface may be coplanar with the portion of the upper surface.

In some implementations, the distal peripheral surface engages the lower surface such that the substrates defines a second hollow support.

In some implementations, the distal peripheral surface is coplanar with the proximal peripheral surface.

In some implementations, the distal peripheral surface faces a first direction and the proximal peripheral surface faces a second direction opposite the first direction. The distal peripheral surface may face a first direction and the proximal peripheral surface may face a second direction opposite the first direction.

In some implementations, a first portion of the upper surface engages a second portion of the upper surface. The first portion of the upper surface may be attached to the second portion of the upper surface.

In some implementations, the substrate further comprises a third seam spaced apart from the first and second seams, and a fourth seam spaced apart from the first, second, and third seams. The third and fourth seams may extend in a direction parallel to the distal peripheral surface. A portion of the upper surface may define a multi-sided shape extending between at least three of the first, second, third, and fourth seams. The multi-sided shape may define a portion of one of a hexagon, an octagon, or a decagon. In some implementations, the multi-sided shape defines an arc. A portion of the lower surface may define a multi-sided shape extending between at least three of the first, second, third, and fourth seams. The portion of the lower surface may be parallel to the portion of the upper surface.

In some implementations, the furniture unit includes a second substrate and a splice. The second substrate may define a second hollow support. The splice may be disposed within the first hollow support and the second hollow support.

Another aspect of the disclosure provides a furniture unit comprising at least one shelf. The shelf may include a substrate having an upper surface, a lower surface, a proximal peripheral surface, a distal peripheral surface, a first seam, a second seam, a third seam, and a fourth seam. The lower surface may be opposite the upper surface. The proximal peripheral surface may extend from the upper surface to the lower surface. The distal peripheral surface may be opposite the proximal peripheral surface and may extend from the upper surface to the lower surface. Each of the first, second, third, and fourth seams may be spaced apart from the others of the first, second, third, and fourth seams and may extend in a direction parallel to the proximal peripheral surface. A portion of the upper surface may define a multi-sided shape extending between at least three of the first, second, third, and fourth seams.

This aspect may include one or more of the following optional features. In some implementations, the proximal peripheral surface engages one of the distal peripheral surface, the upper surface, or the lower surface.

In some implementations, the multi-sided shape defines a portion of one of a hexagon, an octagon, or a decagon. The multi-sided shape may define an arc. In some implementations, the multi-sided shape defines a portion of one of a hexagon, an octagon, or a decagon. The multi-sided shape may define an arc.

In some implementations, a portion of the lower surface defines a multi-sided shape extending between at least three of the first, second, third, and fourth seams. The portion of the lower surface may be parallel to the portion of the upper surface.

Another aspect of the disclosure provides a furniture unit comprising a first substrate, a second substrate, and a splice. The first substrate may include a first upper surface, a first lower surface, a proximal peripheral surface, a distal peripheral surface, a first seam, and a second seam. The first lower surface may be opposite the first upper surface. The proximal peripheral surface may extend from the first upper surface to the first lower surface. The distal peripheral surface may be opposite the proximal peripheral surface and extend from the first upper surface to the first lower surface.

The second seam may be spaced apart from the first seam. The first and second seams may extend in a direction parallel to the proximal peripheral surface. The proximal peripheral surface may engage the first lower surface such that the first substrate defines a first hollow support. The second substrate may include a second upper surface and a second lower surface opposite the second upper surface. The second lower surface may define a second hollow support. The splice may be disposed within the first hollow support and the second hollow support.

Another embodiment of the invention is a method of assembling a furniture unit, including: folding a first substrate at a first channel and at a second channel to form a first support having a first void; folding a second substrate at a third channel and at a fourth channel to form a second support having a second void; and inserting a splice within both the first void and the second void. In other aspects: at least one of the first channel, second channel, third channel, and fourth channel may be defined by a first channel wall and a second channel wall; or the first channel may be defined by the first channel wall and the second channel wall, the second channel may be defined by a third channel wall and a fourth channel wall, the third channel may be defined by a fifth channel wall and a six channel wall, and the fourth channel may be defined by a seventh channel wall and an eighth channel wall. In some aspects, the first channel wall may engage the second channel wall; or the first channel wall may engage the second channel, the third channel wall may engage the fourth channel wall, the fifth channel wall may engage the six channel wall, and the seventh channel wall may engage the eighth channel wall. Further, the first void, the second void, and the splice each may have a cross-sectional shape; and the cross-sectional shape of the first void, the cross-sectional shape of the second void, and the cross-sectional shape of the splice may be substantially the same. In another aspect, the first, second, third, or fourth channels may be formed by miter cutting through a portion of the first substrate or a portion of the second substrate.

The details of one or more implementations of the disclosure are set forth in the accompanying drawings and the description below. Other aspects, features, and advantages will be apparent from the description and drawings, and from the claims.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
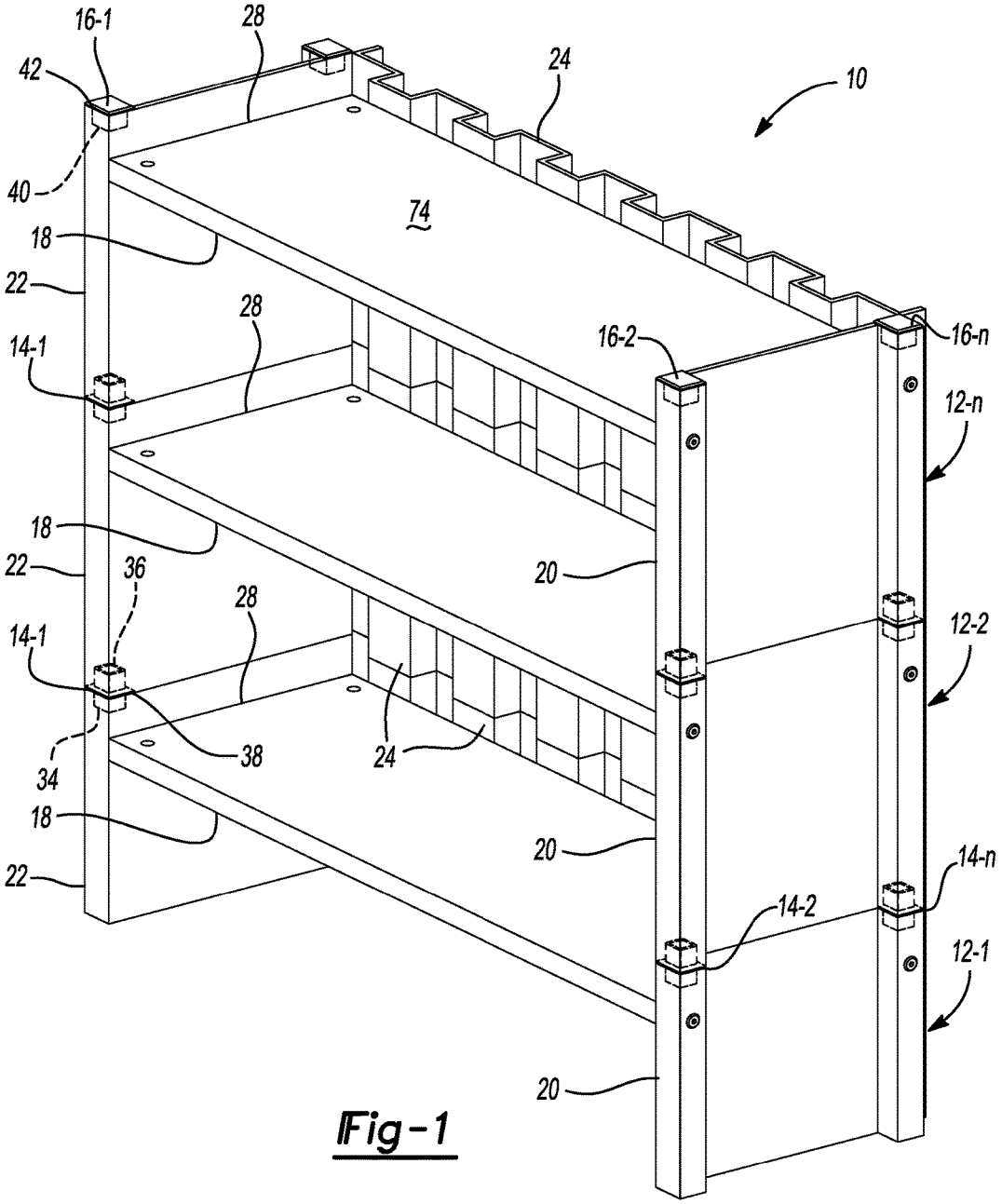
FIG. 1 is a perspective view of a furniture unit in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Figure 2:
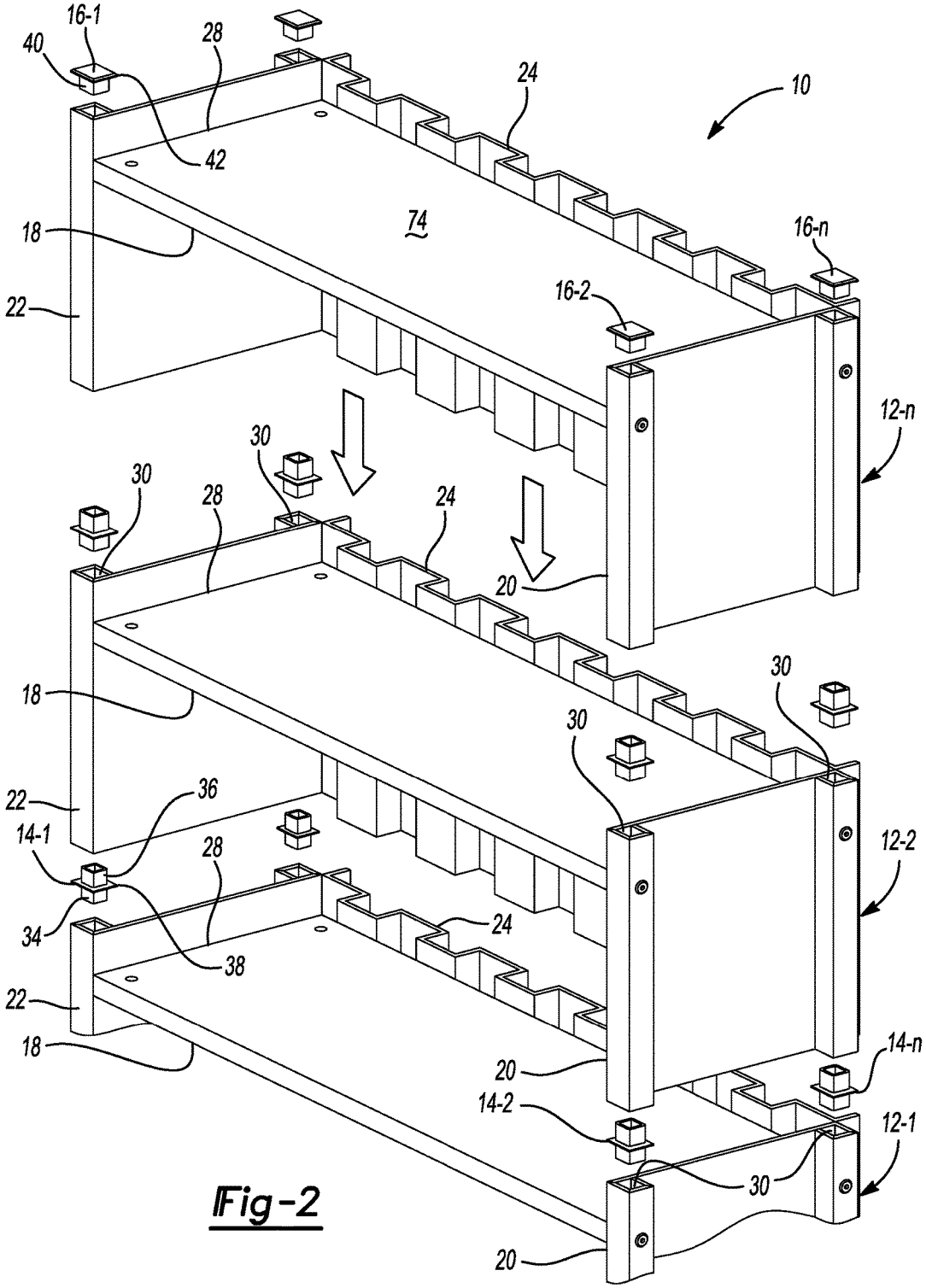
FIG. 2 is an exploded view of the furniture unit of FIG. 1.
Figure 3:
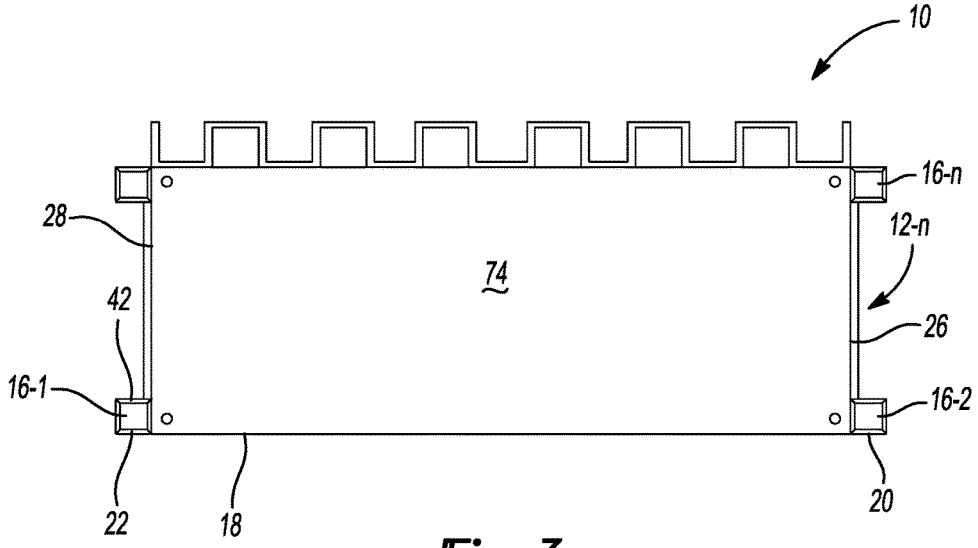
FIG. 3 is a top view of the furniture unit of FIG. 1.

With reference to FIGS. 1-3, a furniture unit 10 is provided. While the furniture unit 10 is generally shown and described herein as being a bookcase, it will be appreciated that the furniture unit 10 (e.g., shelves, legs, backer, etc.), or parts thereof, may include, or otherwise be utilized as, other types of home or office furniture or fixtures (e.g., tables, bed frames, desks, doors, ceiling panels, ceiling baffles, etc.) within the scope of the present disclosure.

The furniture unit 10 may include one or more shelf sections 12-1, 12-2, . . . **12-*n*, one or more connectors 14-1, 14-2, . . . 14-*n*, and one or more caps 16-1, 16-2, . . . 16-*n*. Each shelf section 12-1, 12-2, . . . 12-*n* may include a shelf 18, a lateral leg 20, a medial leg 22, and a backer 24. The shelf 18 may extend from a lateral end 26 to a medial end 28 opposite the lateral end 26. The lateral leg 20 may be coupled to, or otherwise supported by, the lateral end 26 of the shelf 18. The medial leg 22 may be coupled to, or otherwise supported by, the medial end 28 of the shelf 18. As illustrated in FIG. 3, the backer 24 may be coupled to, or otherwise supported by, the shelf 18, the lateral leg 20, and/or the medial leg 22**.

As illustrated in FIG. 2, the lateral and medial legs 20, 22 may each define a substantially hollow construct having upper and lower openings 30, 32. The upper and lower openings 30, 32 may define any of a variety of shapes. For example, while the upper and lower openings 30, 32 are generally illustrated as defining rectangular (e.g., square) shapes, it will be appreciated that the upper and lower openings may define another shape such as a triangle, a circle, or another polygon within the scope of the present disclosure. In some implementations, the lateral and/or medial leg 20, 22 may include the shelf 18, or a construct substantially similar thereto. For example, the lateral leg 20 may define another shelf, substantially similar or identical to shelf 18, supported by the lateral end 26 of the shelf 18, and the medial leg 22 may define another shelf, substantially similar or identical to shelf 18, supported by the medial end 28 of the shelf 18.

With further reference to FIG. 2, the connectors 14-1, 14-2, . . . **14-*n* may each include a first coupling portion 34, a second coupling portion 36, and a stop portion 38. The first and second coupling portions 34, 36 may define any of a variety of shapes. For example, while the first and second coupling portions 34, 36 are generally illustrated as defining rectangular (e.g., square) shapes, it will be appreciated that the first and second coupling portions 34, 36 may each define another shape such as a triangle, a circle, or another polygon within the scope of the present disclosure. In this regard, the size and shape of the first and second coupling portions 34, 36 may correspond to the size and shape of one or both of the upper or lower openings 30, 32 of the lateral and medial legs 20, 22, such that the upper or lower openings 30, 32 can receive the first or second coupling portions 34, 36 of the connectors 14-1, 14-2, . . . 14-*n*** in an assembled configuration, as described in more detail below.

The stop portion 38 may extend outwardly from, or otherwise relative to, the first or second coupling portions 34, 36 of the connectors 14-1, 14-2, . . . **14-*n*. In some implementations, the stop portion 38 defines an outwardly extending flange relative to the first and second coupling portions 34, 36. In this regard, the stop portion 38 may define a shape that is substantially similar to the shape defined by the first or second coupling portions 34, 36**.

The caps 16-1, 16-2, . . . **16-*n* may each include a coupling portion 40 and a stop portion 42. The coupling portion 40 may define any of a variety of shapes. For example, while the coupling portion 40 is generally illustrated as defining a rectangular (e.g., square) shape, it will be appreciated that the coupling portion 40 may define another shape such as a triangle, a circle, or another polygon within the scope of the present disclosure. In this regard, the size and shape of the coupling portion 40 may correspond to the size and shape of one or both of the upper or lower openings 30, 32 of the lateral and medial legs 20, 22, such that the upper or lower openings 30, 32 can receive the coupling portion 40 of the caps 16-1, 16-2, . . . 16-*n* in an assembled configuration, as described in more detail below. The stop portion 42 may extend outwardly from, or otherwise relative to, the coupling portion 40 of the caps 16-1, 16-2, . . . 16-*n*. In some implementations, the stop portion 42 defines an outwardly extending flange at, and relative to, an uppermost portion of the coupling portion 40. In this regard, the stop portion 42 may define a shape that is substantially similar to the shape defined by the coupling portion 42**.

As illustrated in FIGS. 1 and 2, in the assembled configuration, the shelf sections 12-1, 12-2, . . . **12-*n* may be arranged in a stacked configuration. In this regard, the lateral leg 20 of the first shelf section 12-1 may be removably coupled to the lateral leg 20 of the second shelf section 12-2, and the medial leg 22 of the first shelf section 12-1 may be removably coupled to the medial leg 22 of the second shelf section 12-2. For example, one or more connectors 14-1, 14-2, . . . 14-*n* may be removably coupled to the lateral leg 20 of the first shelf section 12-1 and to the lateral leg 20 of the second shelf section 12-1, and another one or more connectors 14-1, 14-2, . . . 14-*n* may be removably coupled to the medial leg 22 of the first shelf section 12-1 and to the medial leg 22 of the second shelf section 12-1. In particular, the first coupling portion 34 of one or more of the connectors 14-1, 14-2, . . . 14-*n* may be disposed within one or more of the upper openings 30 of the lateral leg 20 of the first shelf section 12-1, and the second coupling portion 36 may be disposed within one or more of the lower openings 32 of the lateral leg 20 of the second shelf section 12-2, such that the stop portion 38 engages the lateral legs 20 of the first and second shelf sections 12-1, 12-2. Similarly, the first coupling portion 34 of one or more of the connectors 14-1, 14-2, . . . 14-*n* may be disposed within one or more of the upper openings 30 of the medial leg 22 of the first shelf section 12-1, and the second coupling portion 36 may be disposed within one or more of the lower openings 32 of the medial leg 22 of the second shelf section 12-2, such that the stop portion 38 engages the medial legs 22 of the first and second shelf sections 12-1, 12-2**.

Figure 4A:
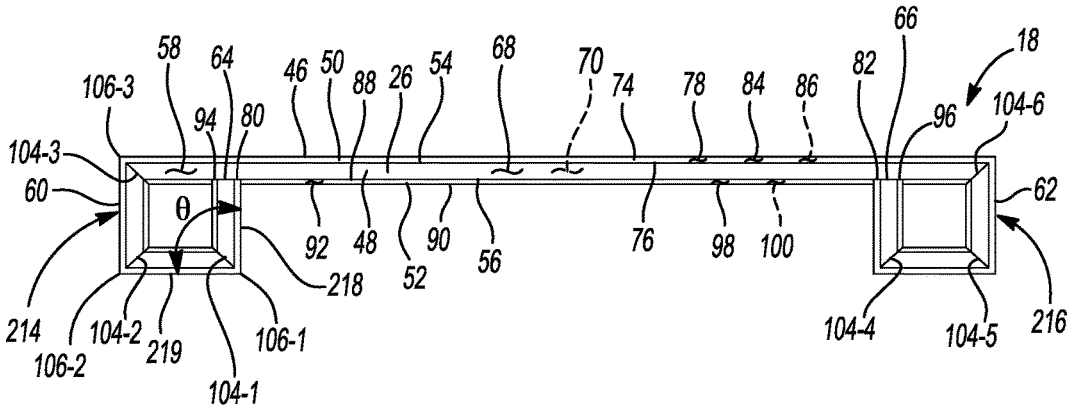
FIG. 4A is an end view of a shelf for use with the furniture unit of FIG. 1.
Figure 4B:
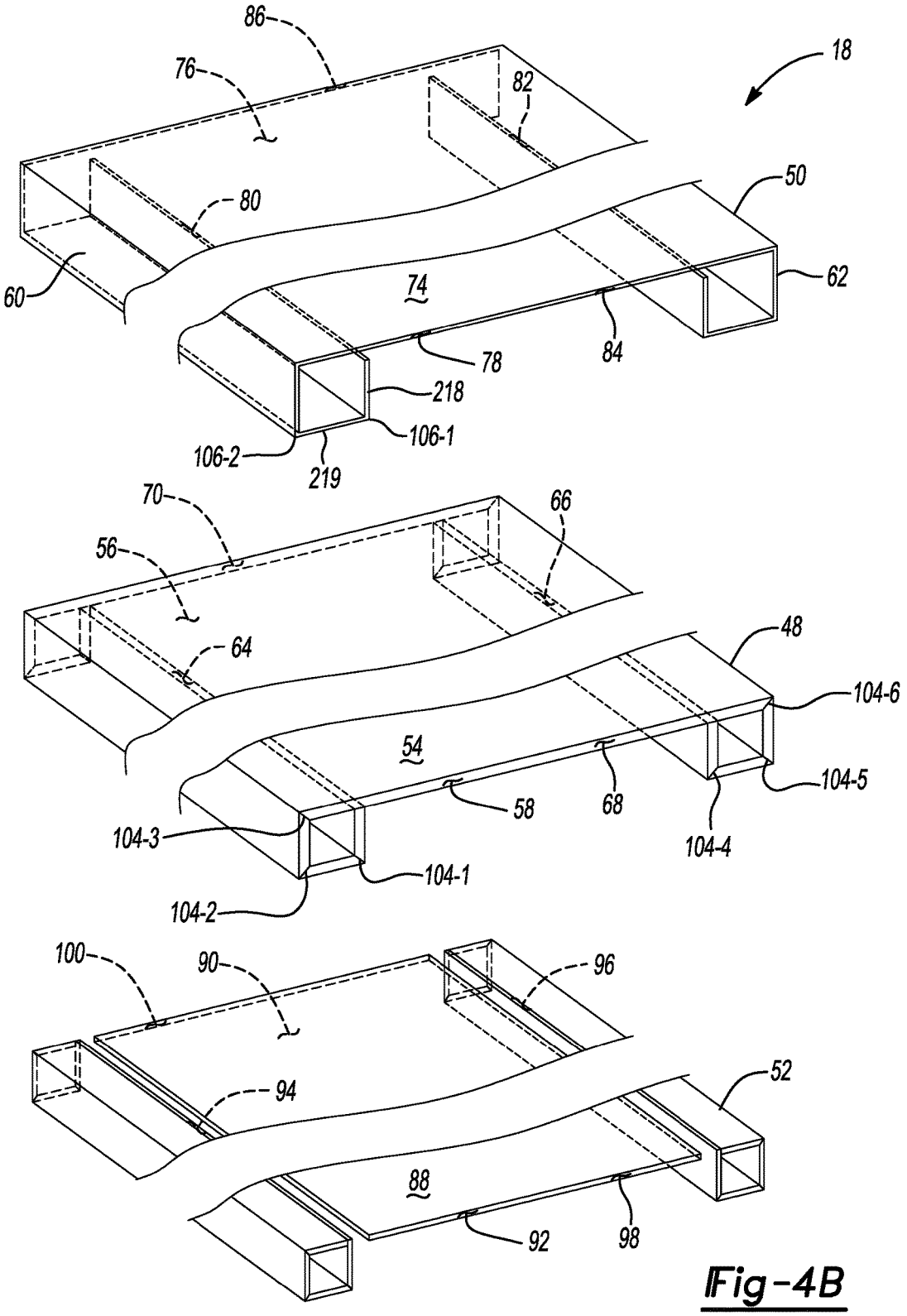
FIG. 4B is an exploded view of the shelf of FIG. 4A.

With reference to FIGS. 4A and 4B, the shelf 18 may include, or otherwise be formed from, a substrate 46 having a layered construct. In this regard, the substrate 46 may include a base layer 48, an upper laminate layer 50, and a lower laminate layer 52. The base layer 48 and the upper and lower laminate layers 50, 52 may each be formed from one or more of a variety of materials. In some implementations, the base layer 48 is formed from a medium-density fiberboard material, a polymer material (e.g., polyvinyl chloride), or a particle board material, and the laminate layers 50, 52 are formed from a paper material or a polymer material (e.g., polypropylene).

The base layer 48 may include an upper surface 54, a lower surface 56 opposite the upper surface 54, and a peripheral surface 58. The upper and lower surfaces 54, 56 may extend from a proximal portion 60 of the substrate 46 to a distal portion 62 of the substrate 46. The peripheral surface 58 may extend from the upper surface 54 to the lower surface 56. In this regard, the peripheral surface 58 may include a proximal peripheral surface 64, a distal peripheral surface 66, a lateral peripheral surface 68, and a medial peripheral surface 70. The proximal peripheral surface 64 may be disposed in the proximal portion 60 of the substrate 46. The distal peripheral surface 66 may be disposed in the distal portion 62 of the substrate 46 opposite the proximal peripheral surface 64. The lateral peripheral surface 68 may extend from the proximal peripheral surface 64 to the distal peripheral surface 66. The medial peripheral surface 70 may extend from the proximal peripheral surface 64 to the distal peripheral surface 66 opposite the lateral peripheral surface 68.

The upper laminate layer 50 may include an upper surface 74, a lower surface 76 opposite the upper surface 74, and a peripheral surface 78. The upper and lower surfaces 74, 76 may extend from the proximal portion 60 of the substrate 46 to the distal portion 62 of the substrate 46. The peripheral surface 78 may extend from the upper surface 74 to the lower surface 76. In this regard, the peripheral surface 78 may include a proximal peripheral surface 80, a distal peripheral surface 82, a lateral peripheral surface 84, and a medial peripheral surface 86. The proximal peripheral surface 80 may be disposed in the proximal portion 60 of the substrate 46. The distal peripheral surface 82 may be disposed in the distal portion 62 of the substrate 46 opposite the proximal peripheral surface 80. The lateral peripheral surface 84 may extend from the proximal peripheral surface 80 to the distal peripheral surface 82. The medial peripheral surface 86 may extend from the proximal peripheral surface 80 to the distal peripheral surface 82 opposite the lateral peripheral surface 84.

The lower laminate layer 52 may include an upper surface 88, a lower surface 90 opposite the upper surface 88, and a peripheral surface 92. The upper and lower surfaces 88, 90 may extend from the proximal portion 60 of the substrate 46 to the distal portion 62 of the substrate 46. The peripheral surface 92 may extend from the upper surface 88 to the lower surface 90. In this regard, the peripheral surface 92 may include a proximal peripheral surface 94, a distal peripheral surface 96, a lateral peripheral surface 98, and a medial peripheral surface 100. The proximal peripheral surface 94 may be disposed in the proximal portion 60 of the substrate 46. The distal peripheral surface 96 may be disposed in the distal portion 62 of the substrate 46 opposite the proximal peripheral surface 94. The lateral peripheral surface 98 may extend from the proximal peripheral surface 94 to the distal peripheral surface 96. The medial peripheral surface 100 may extend from the proximal peripheral surface 94 to the distal peripheral surface 96 opposite the lateral peripheral surface 98.

In the assembled configuration, the upper surface 54 of the base layer 48 may engage the lower surface 76 of the upper laminate layer 50, and the lower surface 56 of the base layer 48 may engage the upper surface 88 of the lower laminate layer 52, such that the upper surface 74 of the upper laminate layer 50, the lower surface 90 of the lower laminate layer 52, the peripheral surface 58 of base layer 48, the peripheral surface 78 upper laminate layer 50, and the peripheral surface 92 of lower laminate layer 52 define outermost surfaces of the substrate 46. In some implementations, the upper surface 54 of the base layer 48 may be bonded to the lower surface 76 of the upper laminate layer 50 using an adhesive or other suitable technique, and the lower surface 56 of the base layer 48 may be bonded to the upper surface 88 of the lower laminate layer 52 using an adhesive or other suitable technique. While the substrate 46 is generally shown and described herein as including the base layer 48, the upper laminate layer 50, and the lower laminate layer 52, the substrate 46 may include the base layer 48 and one of the upper and lower laminate layers 50, 52 within the scope of the present disclosure. In this regard, in some implementations, the upper surface 54 or the lower surface 56 of the base layer 48 may define an outermost surface of the substrate 46.

As illustrated in FIG. 4A, the shelf 18 may include, or otherwise define, a first seam 104-1, a second seam 104-2 spaced apart from the first seam 104-1, and a third seam 104-3 spaced apart from the first and second seams 104-1, 104-2. It will be appreciated that the shelf 18 may include more or less than three seams within the scope of the present disclosure. For example, as illustrated in FIG. 4A, in some implementations, the shelf 18 may include first, second and third seams 104-1, 104-2, 104-3 in the proximal portion 60 of the substrate 46, and fourth, fifth, and sixth seams 104-4, 104-5, 104-6 in the distal portion 62 of the substrate 46. The seams 104-1, 104-2, 104-3 may extend through the base layer 48. Where the substrate 46 includes the base layer 48 and both of the upper and lower laminate layers 50, 52, the seams 104-1, 104-2, 104-3 may extend through the base layer 48 and through one of the upper and lower laminate layers 50, 52. Where the substrate 46 includes the base layer 48 and one of the upper and lower laminate layers 50, 52, the seams 104-1, 104-2, 104-3 may extend through only the base layer 48. The seams 104-1, 104-2, . . . **104-*n* may extend from the lateral peripheral surfaces 68, 84, 98 to the medial peripheral surfaces 70, 86, 100. In this regard, the seams 104-1, 104-2, 104-3 may extend in a direction substantially parallel (+/−5 degrees) to the proximal peripheral surfaces 64, 80, 94 or the distal peripheral surfaces 66, 82, 96**.

With continued reference to FIGS. 4A and 4B, the shelf 18 may further include, or otherwise define, a first fold 106-1, a second fold 106-2 spaced apart from the first fold 106-1, and a third fold 106-3 spaced apart from the first and second folds 106-1, 106-2. It will be appreciated that the shelf 18 may include more or less than three folds within the scope of the present disclosure. In this regard, the number "n" of folds 106-1, 106-2, . . . **106-*n* may equal the number of seams 104-1, 104-2, . . . 104-*n*. Where the substrate 46 includes the base layer 48 and both of the upper and lower laminate layers 50, 52, the folds 106-1, 106-2, 106-3 may be formed in the one of the upper and lower laminate layers 50, 52 which does not include the seams 104-1, 104-2, 104-3 . . . . Where the substrate 46 includes the base layer 48 and one of the upper and lower laminate layers 50, 52, the folds 106-1, 106-2, 106-3 may be formed in that one of the upper and lower laminate layers 50, 52. The folds 106-1, 106-2, 106-3 may extend from the lateral peripheral surfaces 68, 84, 98 to the medial peripheral surfaces 70, 86, 100. In some implementations, the folds 106-1, 106-2, 106-3 extend in a direction substantially parallel (+/−5 degrees) to the proximal peripheral surfaces 64, 80, 94 or the distal peripheral surfaces 66, 82, 96. In this regard, each fold 106-1, 106-2, . . . 106-*n* may be aligned with one of the seams 104-1, 104-2, . . . 104-*n***.

With reference to FIGS. 4 and 14A-14D, a method of manufacturing any component of shelf section 12-1, 12-2, . . . **12-*n* (i.e, shelf 18, lateral leg 20, medial leg 22, and backer 24) of the furniture unit 10 will now be described. The component of shelf section 12-1, 12-2, . . . 12-*n* may be manufactured from the substrate 46 having a thickness T extending between an upper surface (e.g., upper surface 74) and a lower surface (e.g., lower surface 90**). The thickness T may be between two millimeters and ten millimeters. In some implementations, the thickness T may be substantially equal to five millimeters.

Figure 14A:
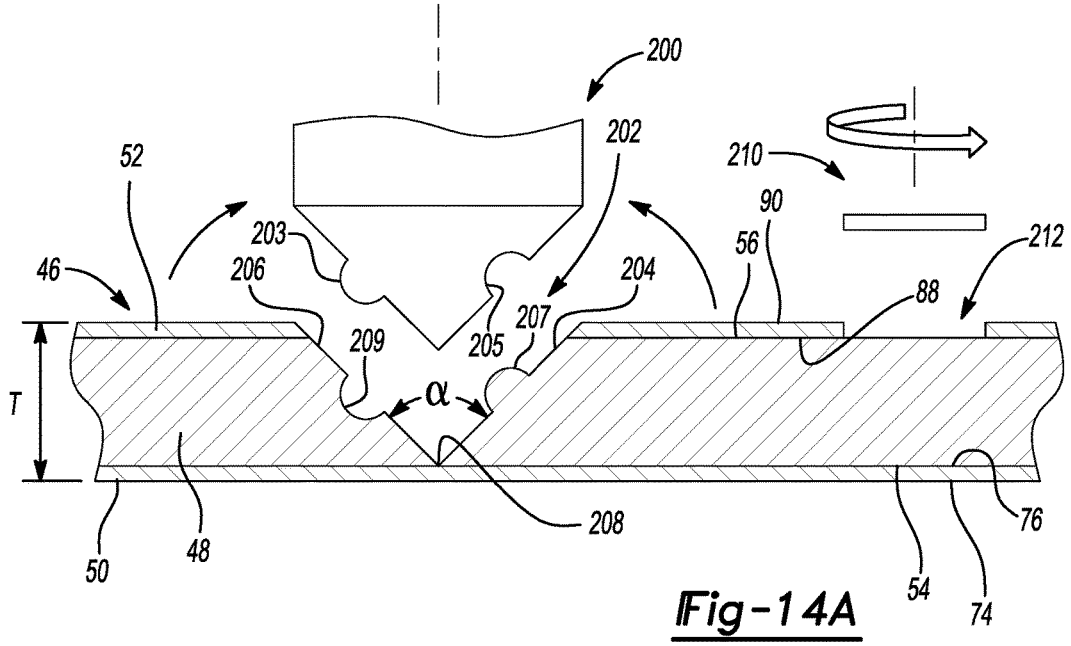
FIG. 14A is cross-sectional view of a substrate during a method of manufacturing the furniture unit of FIG. 1.

With particular reference to FIG. 14A, the method may include providing a tool 200 (e.g., a router, a blade, a bit, etc.) and using the tool to form a plurality of primary channels 202 in the substrate 46, e.g, by miter cutting the plurality of primary channels 202 in the substrate 46. In this regard, the number and location of the primary channels 202 may correspond to the number and location of the seams 104-1, 104-2, . . . **104-*n* or the number and location of the folds 106-1, 106-2, . . . 106-*n*. The tool 200 may include a male portion 203 and a female portion 205 opposite the male portion 203. As illustrated, in some configurations, the male portion 203 defines a convex profile and the female portion 205 defines a concave profile. It will be appreciated, however, that the male and female portions 203, 205 may define other profiles (e.g., triangular, rectangular, etc.) within the scope of the present disclosure. In this regard, the size and shape of the male portion 203 may correspond to, or otherwise be the same as, the size and shape of the female portion 205. Accordingly, as illustrated in FIG. 14A, the primary channels 202 may be defined by a first channel wall 204 having a male portion 207 formed by the female portion 205 of the tool 200, and a second channel wall 206 having a female portion 209 formed by the male portion 203 of the tool 200**.

The first and second channel walls 204, 206 may extend through a majority of the thickness T of the substrate 46. For example, the first and second channel walls 204, 206 may extend through between approximately seventy percent of the thickness T of the substrate 46 and ninety-nine percent of the thickness T of the substrate 46. In some implementations, the first and second channel walls 204, 206 may extend through an entirety of the base layer 48 and through an entirety of the lower laminate layer 52. In this regard, the first and second channels walls 204, 206 may define a common edge 208 adjacent the lower surface 76 of upper laminate layer 50, and have an angle $\alpha$ therebetween. The angle $\alpha$ may be between about fifteen degrees and about one hundred sixty-five degrees. As illustrated in FIG. 14A, in some implementations, the angle $\alpha$ is substantially equal to ninety degrees.

With continued reference to FIG. 14A, the method may further include providing a tool 210 and forming one or more secondary channels 212 in the substrate 46. As illustrated in FIG. 14A, the secondary channels 212 may extend through the lower laminate layer 52 to expose the lower surface 56 of the base layer 48. In this regard, forming the secondary channels 212 may include removing a portion of the lower laminate layer 52. The secondary channels 212 may extend from the lateral peripheral surfaces 68, 84, 98 to the medial peripheral surfaces 70, 86, 100.

Figure 14B:
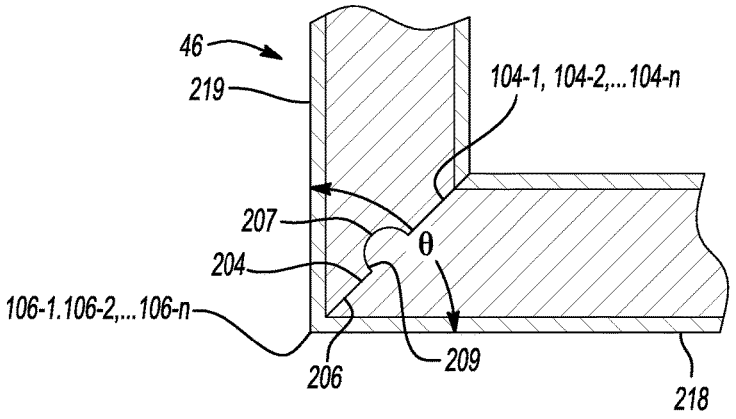
FIG. 14B is cross-sectional view of a substrate during a method of manufacturing the furniture unit of FIG. 1.

With reference to FIG. 14B, the method may also include folding the substrate 46 such that each first channel wall 204 of primary channel 202 engages the second channel wall 206 of the same of primary channel 202 to define a corresponding seam **104-*n* and fold 106-*n*. In this regard, the female portion 209 of each primary channel 202 may receive the male portion 207 of such primary channel 202. For example, the method may include performing a plurality of folding operations to define the plurality of seams 104-1, 104-2, . . . 104-*n* and the plurality of folds 106-1, 106-2, . . . 106-*n*. In this regard, each fold 106-1, 106-2, . . . 106-*n* may define, or otherwise act as, a hinge for folding the substrate 46. Accordingly each fold 106-1, 106-2, . . . 106-*n* may be referred to herein as a hinge 106-1, 106-2, . . . 106-*n*. As illustrated in FIGS. 4A and 4B, in some implementations, the folding operations, and the plurality of seams 104-1, 104-2, . . . 104-*n* and the plurality of folds 106-1, 106-2, . . . 106-*n* defined thereby, forms a hollow proximal support 214 at the proximal portion 60 of the substrate 46 and a hollow distal support 216 at the distal portion 62 of the substrate 46. The hollow proximal support 214 and/or the hollow distal support 216 may define a polygonal cross section extending from the lateral peripheral surfaces 68, 84, 98 to the medial peripheral surfaces 70, 86, 100. For example, the hollow proximal support 214 and the hollow distal support 216 may define a rectangular (e.g., square) cross section extending from the lateral peripheral surfaces 68, 84, 98 to the medial peripheral surfaces 70, 86, 100. In this regard, the upper surface 74 of the upper laminate layer 50 may include a first portion 218 and a second portion 219. The first portion 218 may extend from the proximal peripheral surface 80 to a first seam 104-1, and the second portion 219 may extend from the first seam 104-1 to a second seam 104-2. The first portion 218 and the second portion 219 may define an angle $\theta$ therebetween. The angle $\theta$ may be between about fifteen degrees and about one hundred sixty-five degrees. As illustrated in FIGS. 4 and 14**B, in some implementations, the angle $\theta$ is substantially equal to ninety degrees.

Figure 14C:
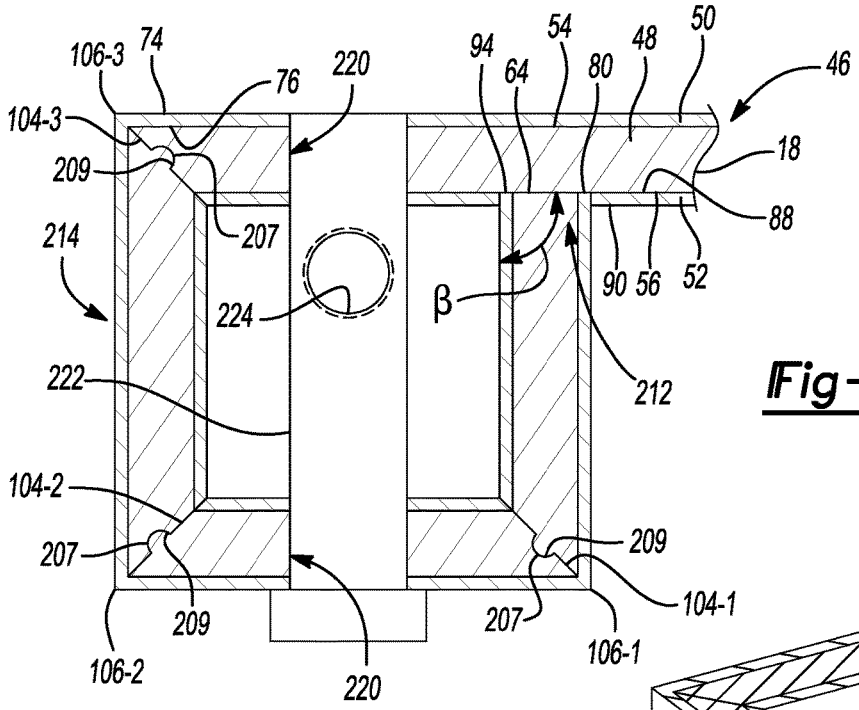
FIG. 14C is cross-sectional view of a substrate during a method of manufacturing the furniture unit of FIG. 1.

With reference to FIG. 14C, folding the substrate 46 may also include engaging the proximal peripheral surfaces 64, 80, or 94 or the distal peripheral surfaces 66, 82, or 96 with the upper surface 54 of the base layer 48 or with the lower surface 56 of the base layer 48. In particular, folding the substrate 46 may include positioning the proximal peripheral surfaces 64, 80, 94 or the distal peripheral surfaces 66, 82, 96 within one of the secondary channels 212 such that the proximal peripheral surfaces 64, 80, 94 or the distal peripheral surfaces 66, 82, 96 engage the upper surface 54 or the lower surface 56 of the base layer 48. In this regard, the proximal peripheral surfaces 64, 80, 94 or the distal peripheral surfaces 66, 82, 96 may define an angle $\beta$ relative to one or more of the upper surfaces 54, 74, 88 or the lower surfaces 56, 76, 90. For example, the proximal peripheral surfaces 64, 80, 94 or the distal peripheral surfaces 66, 82, 96 may define an angle $\beta$ relative to the lower surface 90. The angle $\beta$ may be between about ninety degrees and about one hundred eighty degrees. For example, if the hollow support portion 214 defines a rectangle the angle $\beta$ may be substantially equal to ninety degrees. If the hollow support portion 214 defines a triangle the angle β may be greater than ninety degrees. In some implementations, if the hollow support portion 214 defines a triangle, the angle β may be substantially equal to one hundred twenty degrees.

In some implementations, engaging the proximal peripheral surfaces 64, 80, or 94 or the distal peripheral surfaces 66, 82, or 96 with the upper surface 54 of the base layer 48 or with the lower surface 56 of the base layer 48 may also include coupling the proximal peripheral surfaces 64, 80, or 94 or the distal peripheral surfaces 66, 82, or 96 with the upper surface 54 of the base layer 48 or with the lower surface 56 of the base layer 48 using an adhesive or other suitable technique.

As illustrated in FIGS. 4A and 4B, in some implementations, folding the substrate 46 to form the hollow proximal support 214 and/or the hollow distal support 216 includes folding the proximal portion 60 in a counterclockwise direction and folding the distal portion 62 in a clockwise direction.

With continued reference to FIG. 14C, the method may also include forming one or more apertures 220 through the substrate 46 and placing a primary connector 222 in each of the one or more apertures 220. For example, the method may include forming the one or more apertures 220 through the hollow proximal support 214 or the hollow distal support 216. The primary connector 222 may include a cross-dowel having an aperture 224 formed therein.

Figure 14D:
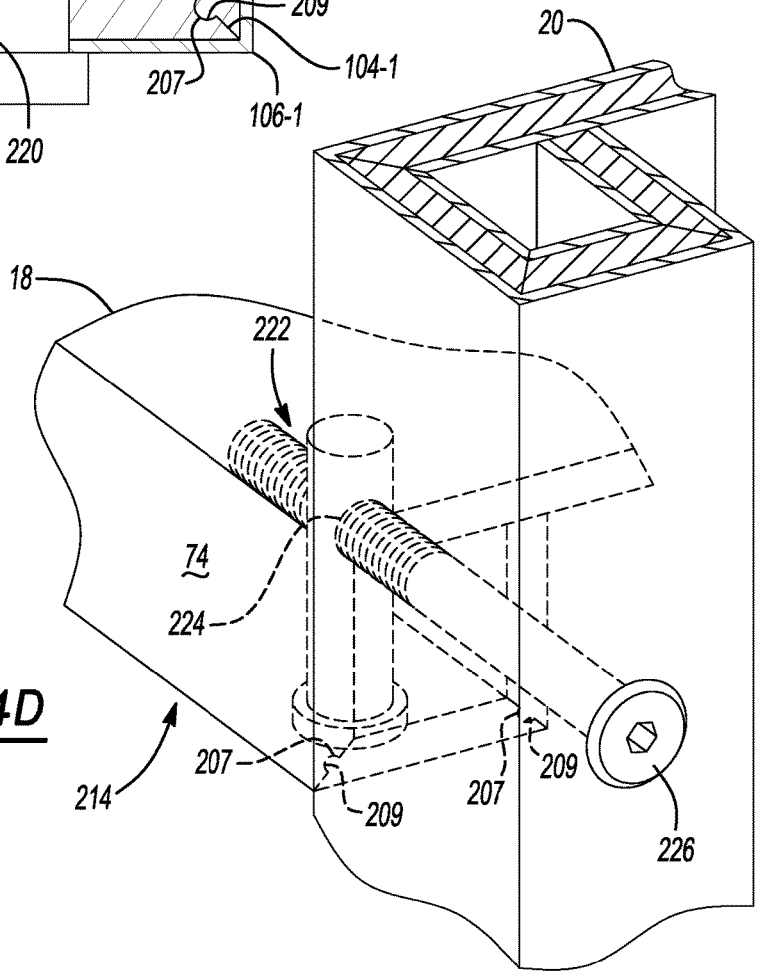
FIG. 14D is cross-sectional view of a substrate during a method of manufacturing the furniture unit of FIG. 1.

With reference to FIG. 14D, the method may further include coupling the shelf 18 to the lateral leg 20 or the medial leg 22. In some implementations, the method may include coupling a secondary connector 226 to each of the primary connectors 222 to couple the shelf 18 to the lateral leg 20 and the medial leg 22. For example, the method may include extending the secondary connectors 226 through the lateral leg 20 or the medial leg 22 and into the aperture 224 of the primary connector 222. In some implementations, extending the secondary connector 226 into the aperture 224 of the primary connector 222 includes threadably engaging the secondary connector 226 with the primary connector 222 within the aperture 224.

Figure 5:
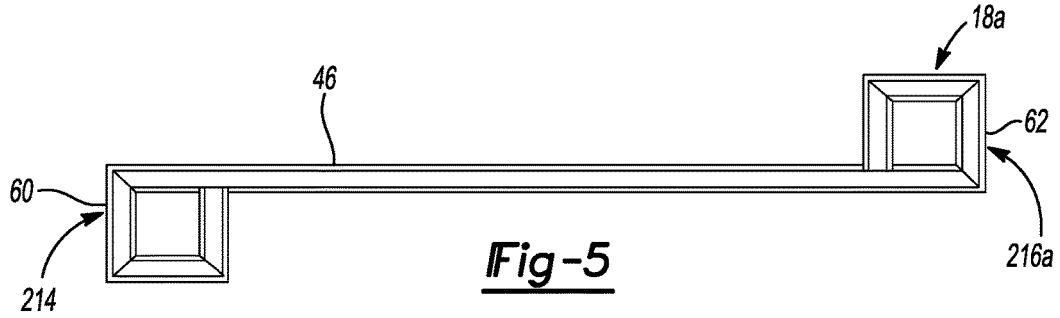
FIG. 5 is an end view of a shelf for use with the furniture unit of FIG. 1.

With reference to FIG. 5, another shelf 18*a* for use with the furniture unit 10 is shown. The structure, function, and method of manufacturing the shelf 18*a* may be substantially similar to that of the shelf 18, apart from any exceptions described below and/or shown in the Figures. Accordingly, the structure and/or function of similar features will not be described again in detail. In addition, like reference numerals are used hereinafter and in the drawings to identify like features, while like reference numerals containing letter extensions (i.e., "a") are used to identify those features that have been modified.

The shelf 18*a* may include the hollow proximal support 214 and a hollow distal support 216*a*. As illustrated in FIG. 5, the hollow proximal support 214 and the hollow distal support 216*a* may be disposed on opposite sides of the shelf 18*a*. In this regard, folding the substrate 46 to form the hollow proximal support 214 may include folding the proximal portion 60 in a counterclockwise direction, and folding the substrate 46 to form the hollow distal support 216*a* may include folding the distal portion 62 in a counterclockwise direction.

Figure 6:
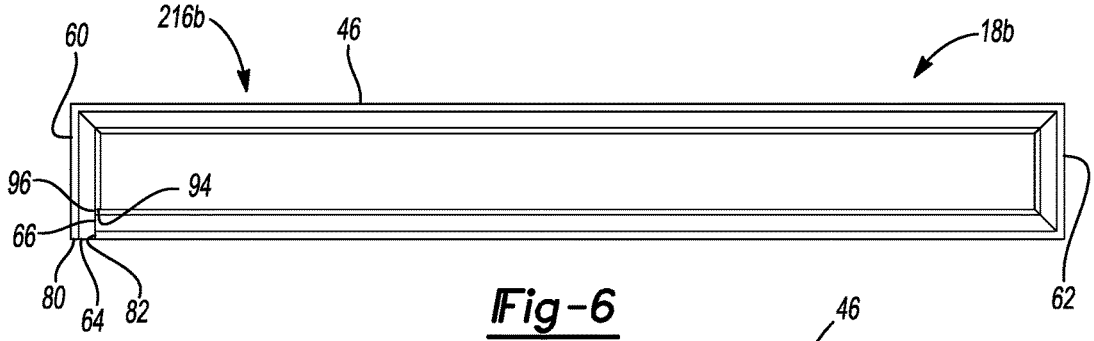
FIG. 6 is an end view of a shelf for use with the furniture unit of FIG. 1.

With reference to FIG. 6, another shelf 18*b* for use with the furniture unit 10 is shown. The structure, function, and method of manufacturing the shelf 18*b* may be substantially similar to that of the shelf 18, apart from any exceptions described below and/or shown in the Figures. Accordingly, the structure and/or function of similar features will not be described again in detail. In addition, like reference numerals are used hereinafter and in the drawings to identify like features, while like reference numerals containing letter extensions (i.e., "b") are used to identify those features that have been modified.

The shelf 18*b* may include a hollow support 216*b* extending from the proximal portion 60 to the distal portion 62 of the substrate 46. In this regard, folding the substrate 46 to form the hollow support 216*b* may include folding the proximal portion 60 in a counterclockwise direction, or folding the distal portion 62 in a clockwise direction, such that the proximal peripheral surfaces 64, 80, or 94 are disposed adjacent the distal peripheral surfaces 66, 82, or 96.

Figure 7A:
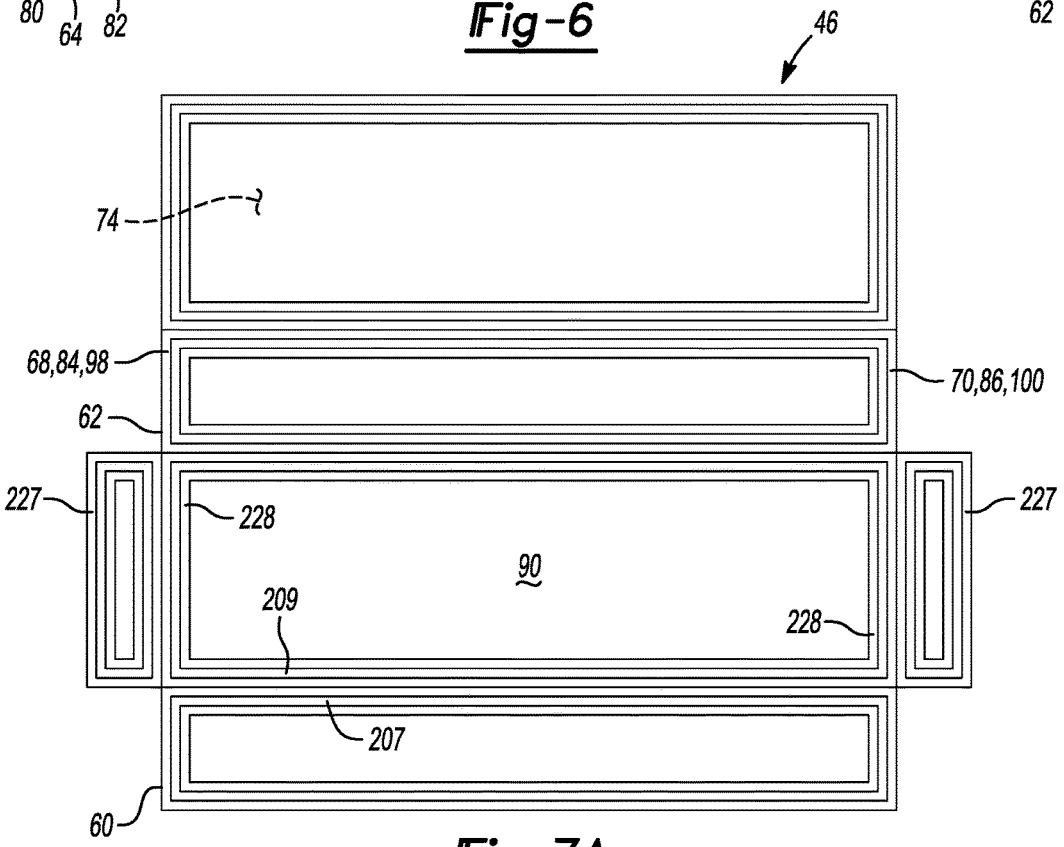
FIG. 7A is a top view of a substrate prior to forming a shelf for use with the furniture unit of FIG. 1.
Figure 7B:
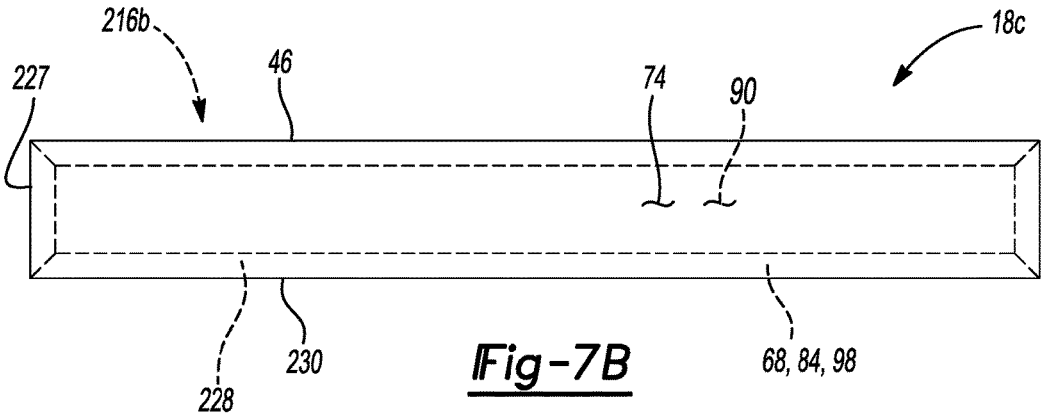
FIG. 7B is an end view of a shelf formed with the substrate of FIG. 7A and for use with the furniture unit of FIG. 1.

With reference to FIGS. 7A and 7B, another shelf 18*c* (FIG. 7A) formed from the substrate 46, and for use with the assembly 10, is shown. The structure, function, and method of manufacturing the shelf 18*c* may be substantially similar to that of the shelf 18*b*, apart from any exceptions described below and/or shown in the Figures. Accordingly, the structure and/or function of similar features will not be described again in detail. In addition, like reference numerals are used hereinafter and in the drawings to identify like features, while like reference numerals containing letter extensions (i.e., "c") are used to identify those features that have been modified.

The substrate 46 of the shelf 18*c* may include the hollow support 216*b* extending from the proximal portion 60 to the distal portion 62 of the substrate 46, and one or more covers 227. The cover 227 may engage a portion 228 of the lateral peripheral surfaces 68, 84, or 98 or a portion 228 of the medial peripheral surfaces 70, 86, or 100. As illustrated in FIG. 7B, in some implementations, the shelf 18*c* may have two covers 227; one cover 227 may engage a portion 228 of the lateral peripheral surfaces 68, 84, or 98 and the other cover 227 may engage a portion 228 of the medial peripheral surfaces 70, 86, or 100. In this regard, in these implementations, the shelf 18*c* may have the appearance of a solid piece (e.g., a solid piece of wood) without any openings. The substrate 46 may further include a fold 230 that may be formed in one of the upper and lower laminate layers 50, 52 such that one of the upper surfaces 54, 74, 88 or one of the lower surfaces 56, 76, 90 engages the portion 228 of the lateral peripheral surfaces 68, 84, or 98 or the medial peripheral surfaces 70, 86, or 100. In some implementations, the shelf 18*c* may be utilized as a ceiling panel or baffle.

Figure 7C:
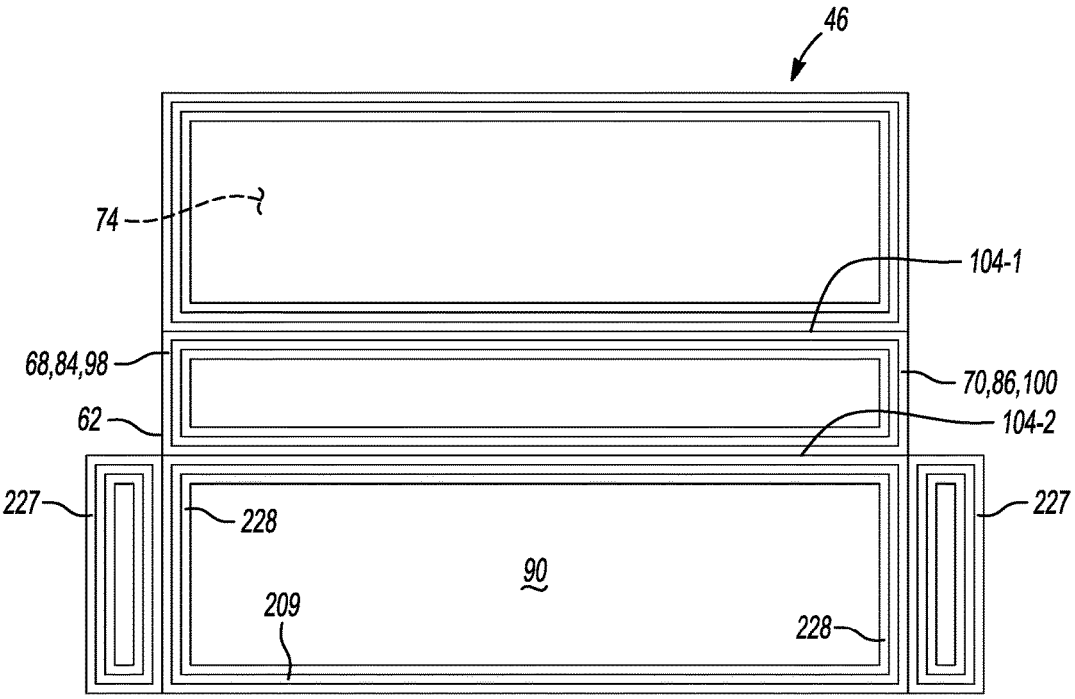
FIG. 7C is a top view of a substrate prior to forming a ceiling baffle.
Figure 7D:
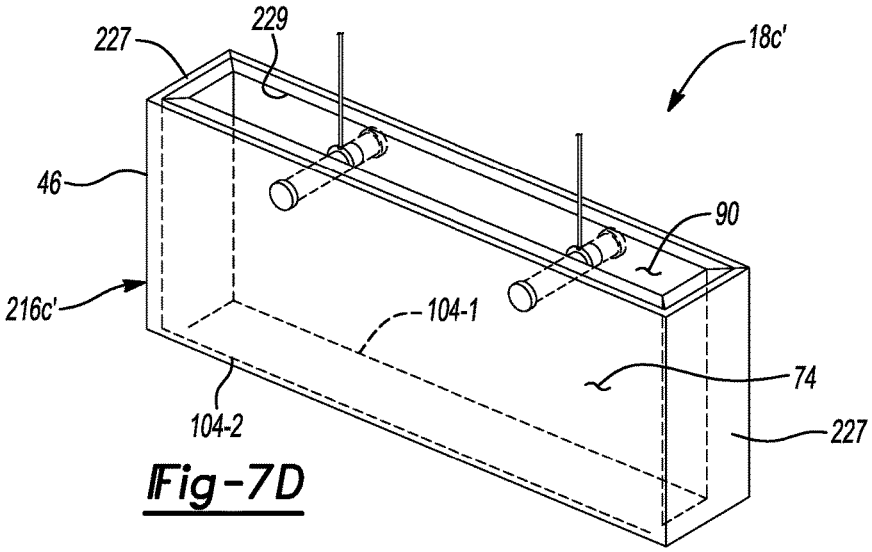
FIG. 7D is a perspective view of a ceiling baffle formed with the substrate of FIG. 7C.

In other implementations, the shelf 18*c* may be formed without one or both of the covers 227, or without one or more of the seams 104-1, 104-2, . . . 104-*n*, such that the shelf 18*c* defines a four-sided construct or a five-sided construct in which each side defines a ninety degree angle relative to any adjacent sides. For example, with reference to FIGS. 7C and 7D, a five-sided ceiling baffle 18*c*' (FIG. 7D), formed from the substrate 46, is shown. The structure, function, and method of manufacturing the ceiling baffle 18*c*' may be substantially similar to that of the shelf 18*c*, apart from any exceptions described below and/or shown in the Figures. In this regard, the substrate 46 may define a ceiling baffle 18*c*' having an opening 229 into the hollow support 216*c*'.

Figure 8:
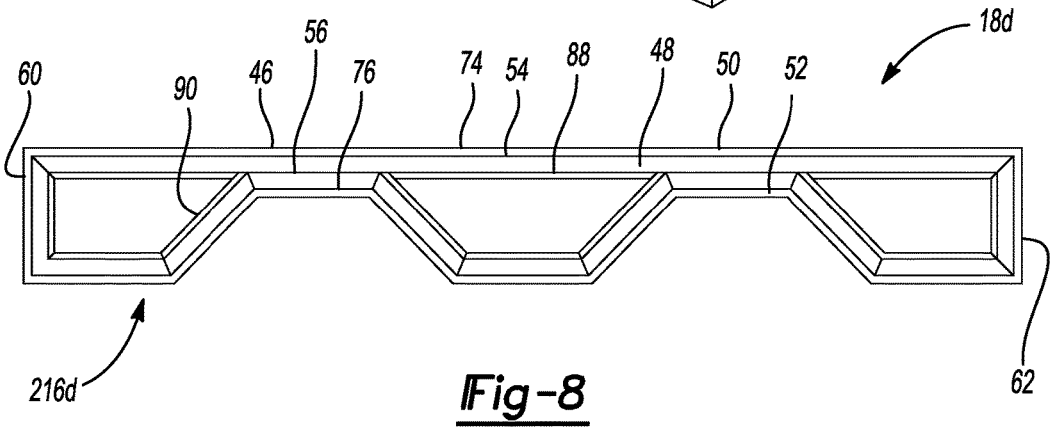
FIG. 8 is an end view of a shelf for use with the furniture unit of FIG. 1.

With reference to FIG. 8, another shelf 18*d* for use with the furniture unit 10 is shown. The structure, function, and method of manufacturing the shelf 18*d* may be substantially similar to that of the shelf 18, apart from any exceptions described below and/or shown in the Figures. Accordingly, the structure and/or function of similar features will not be described again in detail. In addition, like reference numerals are used hereinafter and in the drawings to identify like features, while like reference numerals containing letter extensions (i.e., "d") are used to identify those features that have been modified.

The shelf 18*d* may include a support 216*d* defining a corrugated construct extending from the proximal portion 60 to the distal portion 62 of the substrate 46. In this regard, folding the substrate 46 to form the support 216*d* may include folding one or more portions of the substrate in a clockwise direction and a counterclockwise direction, such that one of the upper surfaces 54, 74, 88 or one of the lower surfaces 56, 76, 90 engages another one of the upper surfaces 54, 74, 88 or one of the lower surfaces 56, 76, 90. As illustrated in FIG. 8, folding the substrate 46 may include directly engaging various portions of the lower surface 56 of the base layer 48 with various other portions of the lower surface 56 of the base layer 48. In other implementations, folding the substrate 46 may include directly engaging various portions of the upper surface 54 of the base layer 48 with various other portions of the upper surface 54 of the base layer 48

Figure 9:
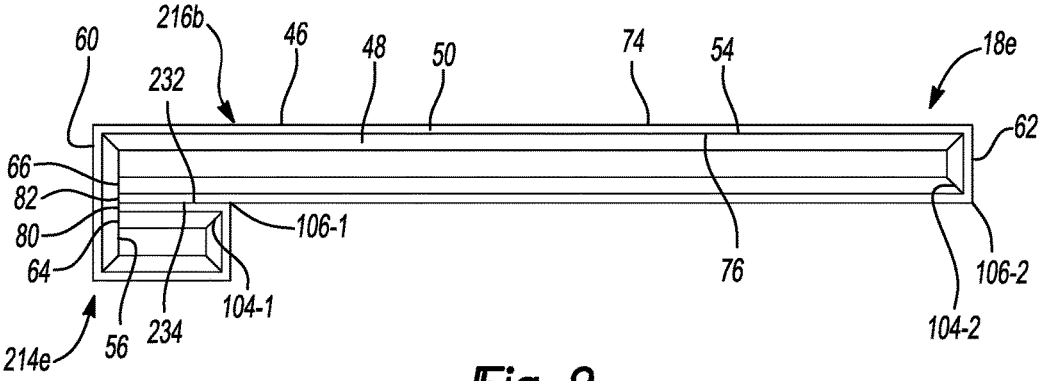
FIG. 9 is an end view of a shelf for use with the furniture unit of FIG. 1.

With reference to FIG. 9, another shelf 18*e* for use with the furniture unit 10 is shown. The structure, function, and method of manufacturing the shelf 18*e* may be substantially similar to that of the shelves 18 and 18*b*, apart from any exceptions described below and/or shown in the Figures. Accordingly, the structure and/or function of similar features will not be described again in detail. In addition, like reference numerals are used hereinafter and in the drawings to identify like features, while like reference numerals containing letter extensions (i.e., "e") are used to identify those features that have been modified. While article 18*e* is generally shown and described herein as being a "shelf 18*e*," it will be appreciated that article 18*e* may be utilized in various ways within the scope of the present disclosure. For example, shelf 18*e* may be utilized as a "shelf" for a bed. In this regard, the shelf 18*e* may be utilized, and referred to herein, as a bedrail.

The shelf 18*e* is a variation of the shelves 18 and 18*b* shown in FIGS. 4 and 6, including a hollow proximal support 214*e* and the hollow distal support 216*b*, and excluding lower laminate layer 52. In particular, the shelf 18*e* may include the hollow support 216*b* extending from the proximal portion 60 to the distal portion 62 of the substrate 46. Folding the substrate 46 may include forming the hollow proximal support 214*e* by folding the proximal portion 60 in a counterclockwise direction, and forming the hollow distal support 216*b* by folding the substrate 46 in a clockwise direction from the proximal portion 60 to the distal portion 62 such that the proximal peripheral surfaces 64, 80 are disposed adjacent the distal peripheral surfaces 66, 82. In some implementations, the proximal peripheral surfaces 64, 80 and the distal peripheral surfaces 66, 82 engage the lower surface 56 of the base layer 48. In this regard, the upper surface 74 of the upper laminate layer 50 may include a first portion 232 (e.g., a forward portion) extending from a first seam 104-1 to the proximal peripheral surfaces 64, 80, and a second portion 234 (e.g., a rearward portion) extending from a second seam 104-2 to the distal peripheral surfaces 66, 82. The first portion 232 of the upper surface 74 may engage the second portion 234 of the upper surface 74. In some implementations, the first portion 232 of the upper surface 74 is attached to the second portion 234 of the upper surface 74. For example, the the first portion 232 of the upper surface 74 may be coupled to the second portion 234 of the upper surface 74 with an adhesive or other suitable fastening technique. The substrate 46 of shelf 18*e* also may include lower laminate layer 52 such that the proximal peripheral surfaces 64, 80, or 94 are disposed adjacent the distal peripheral surfaces 66, 82, or 96; and in some implementations, the proximal peripheral surfaces 64, 80, or 94 and the distal peripheral surfaces 66, 82, or 96 engage the lower surface 90 of the lower laminate layer 52. In some implementations, the proximal peripheral surfaces 64, 80, or 94 and the distal peripheral surfaces 66, 82, or 96 are attached to the lower surface 90 of the lower laminate layer 52.

Figure 10:
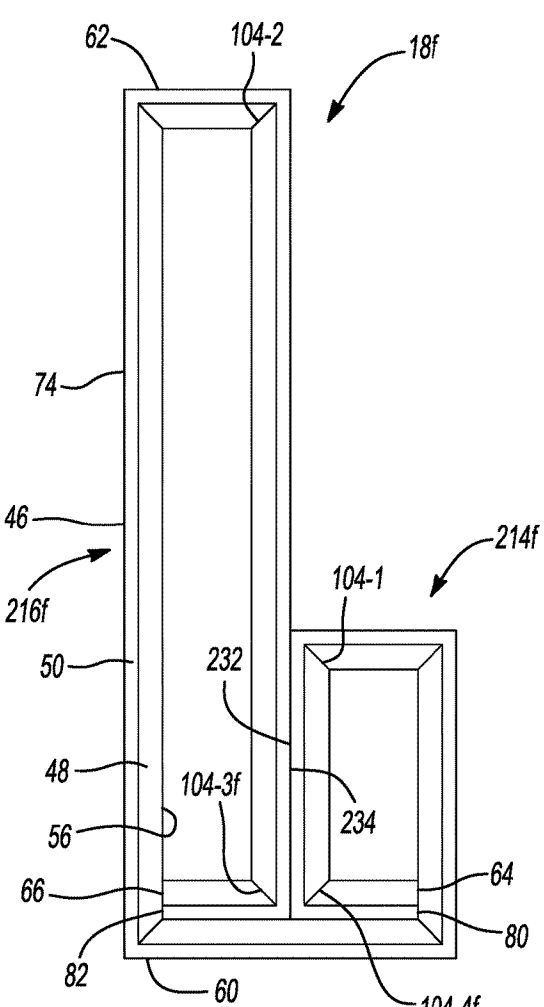
FIG. 10 is an end view of a bedrail in accordance with the principles of the present disclosure.

With reference to FIG. 10, a bedrail 18*f* is shown. The structure, function, and method of manufacturing the bedrail 18*f* may be substantially similar to that of the shelves 18, 18*b*, 18*e*, etc. apart from any exceptions described below and/or shown in the Figures. Accordingly, the structure and/or function of similar features will not be described again in detail. In addition, like reference numerals are used hereinafter and in the drawings to identify like features, while like reference numerals containing letter extensions (i.e., "f") are used to identify those features that have been modified. While article 18*f* is generally shown and described herein as being a "bedrail 18*f*," it will be appreciated that article 18*f* may be utilized in various ways within the scope of the present disclosure. For example, the bedrail 18*f* may be utilized as a "shelf" for use with the furniture unit 10.

The bedrail 18*f* is a variation of the shelf 18*e* shown in FIG. 9, including a hollow proximal support 214*f* and a hollow distal support 216*f*. In some implementations, the bedrail 18*f*, like the shelf 18*e*, excludes the lower laminate layer 52. In other implementations, the bedrail 18*f*, like the shelf 18, includes the lower laminate layer 52. In particular, the bedrail 18*f* may include the hollow support 216*f* extending from the proximal portion 60 to the distal portion 62 of the substrate 46.

Folding the substrate 46 may include forming the hollow proximal support 214*f* by folding the proximal portion 60 in a counterclockwise direction, and forming the hollow distal support 216*f* by folding the substrate 46 in a clockwise direction from the proximal portion 60 to the distal portion 62 such that the proximal peripheral surfaces 64, 80 face a first direction and the distal peripheral surfaces 66, 82 face a second direction opposite (e.g., approximately 180 degrees offset) the first direction. The first portion 232 may extend from the first seam 104-1 to a third seam 104-3*f* and from the third seam 104-3*f* to the proximal peripheral surfaces 64, 80, and the second portion 234 may extend from the second seam 104-2 to a fourth seam 104-4*f* and from the fourth seam 104-4*f* to the distal peripheral surfaces 66, 82. In particular, the first portion 232 may extend in the first direction from the third seam 104-3*f* to the proximal peripheral surfaces 64, 80, and the second portion 234 may extend in the opposite second direction from the fourth seam 104-4*f* to the distal peripheral surfaces 66, 82.

A portion of the upper surface 74 of the upper laminate layer 50, as well as the proximal peripheral surfaces 64, 80 and the distal peripheral surfaces 66, 82, may engage the lower surface 56 of the base layer 48, while the first portion 232 of the upper surface 74 may engage the second portion 234 of the upper surface 74. In some implementations, the first portion 232 of the upper surface 74 is attached to the second portion 234 of the upper surface 74. For example, the first portion 232 of the upper surface 74 may be coupled to the second portion 234 of the upper surface 74 with an adhesive or other suitable fastening technique.

As previously described, the substrate 46 of the bedrail 18*f* also may include lower laminate layer 52 (not shown) such that the proximal peripheral surfaces 64, 80, or 94 face in a direction opposite the distal peripheral surfaces 66, 82, or 96; and in some implementations, the proximal peripheral surfaces 64, 80, or 94 and the distal peripheral surfaces 66, 82, or 96 engage the lower surface 90 of the lower laminate layer 52.

Figure 11:
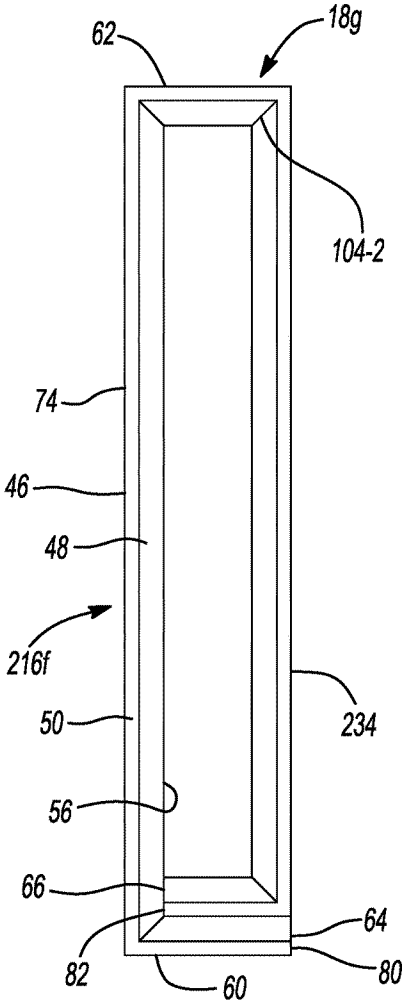
FIG. 11 is an end view of another bedrail in accordance with the principles of the present disclosure.

With reference to FIG. 11, a bedrail 18*g* is shown. The structure, function, and method of manufacturing the bedrail 18*g* may be substantially similar to that of the bedrail 18*f* apart from any exceptions described below and/or shown in the Figures. Accordingly, the structure and/or function of similar features will not be described again in detail. In addition, like reference numerals are used hereinafter and in the drawings to identify like features, while like reference numerals containing letter extensions (i.e., "g") are used to identify those features that have been modified. While article 18*g* is generally shown and described herein as being a "bedrail 18*g*," it will be appreciated that article 18*g* may be utilized in various ways within the scope of the present disclosure. For example, the bedrail 18*g* may be utilized as a "shelf" for use with the furniture unit 10.

The bedrail 18*g* is a variation of the bedrail 18*f* shown in FIG. 10, including the hollow distal support 216*f*. In some implementations, the bedrail 18*g*, like the bedrail 18*f*, excludes the lower laminate layer 52. In other implementations, the bedrail 18*g*, like the bedrail 18*f*, includes the lower laminate layer 52. In particular, the bedrail 18*g* may include the hollow support 216*f* extending from the proximal portion 60 to the distal portion 62 of the substrate 46. Folding the substrate 46 may include forming the hollow distal support 216*f* by folding the substrate 46 in a clockwise direction from the proximal portion 60 to the distal portion 62 such that the proximal peripheral surfaces 64, 80 face a first direction and the distal peripheral surfaces 66, 82 face a second direction opposite (e.g., approximately 180 degrees offset) the first direction. In this regard, the distal peripheral surfaces 66, 82 and a portion of the upper surface 74 of the upper laminate layer 50 may engage the lower surface 56 of the base layer 48, while the second portion 234 of the upper surface 74 may be exposed. In some implementations, the upper surface 74 of the upper laminate layer 50 is attached to the lower surface 56 of the base layer 48. For example, the upper surface 74 of the upper laminate layer 50 may be coupled to the lower surface 56 of the base layer 48 with an adhesive or other suitable fastening technique. In some implementations, the proximal peripheral surfaces 64, 80 are aligned (e.g., flush or coplanar) with the second portion 234 of the upper surface 74.

As previously described, the substrate 46 of the bedrail 18*g* also may include lower laminate layer 52 (not shown) such that the proximal peripheral surfaces 64, 80, or 94 face in a direction opposite the distal peripheral surfaces 66, 82, or 96; and in some implementations, the distal peripheral surfaces 66, 82, or 96 engage the lower surface 90 of the lower laminate layer 52.

Figure 12:
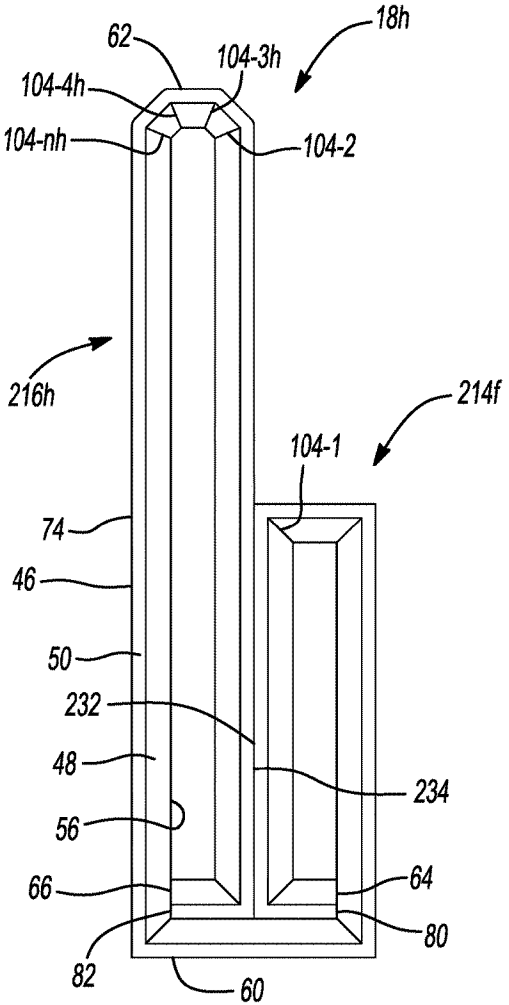
FIG. 12 is an end view of another bedrail in accordance with the principles of the present disclosure.

With reference to FIG. 12, a bedrail 18*h* is shown. The structure, function, and method of manufacturing the bedrail 18*h* may be substantially similar to that of the bedrail 18*f* apart from any exceptions described below and/or shown in the Figures. Accordingly, the structure and/or function of similar features will not be described again in detail. In addition, like reference numerals are used hereinafter and in the drawings to identify like features, while like reference numerals containing letter extensions (i.e., "h") are used to identify those features that have been modified. While article 18*h* is generally shown and described herein as being a "bedrail 18*h*" it will be appreciated that article 18*h* may be utilized in various ways within the scope of the present disclosure. For example, the bedrail 18*h* may be utilized as a "shelf" for use with the furniture unit 10.

The bedrail 18*h* is a variation of the bedrail 18*f* shown in FIG. 10, including the hollow proximal support 214*f* and a hollow distal support 216*h*. In some implementations, the bedrail 18*h*, like the bedrail 18*f*, excludes the lower laminate layer 52. In other implementations, the bedrail 18*h*, like the bedrail 18*f*, includes the lower laminate layer 52. In particular, the bedrail 18*f* may include the hollow support 216*h* extending from the proximal portion 60 to the distal portion 62 of the substrate 46. Folding the substrate 46 may include forming the hollow distal support 216*h* by folding the substrate 46 in a clockwise direction from the proximal portion 60 to the distal portion 62 such that the proximal peripheral surfaces 64, 80 face in a direction opposite (e.g., approximately 180 degrees offset) the distal peripheral surfaces 66, 82. The first portion 232 may extend from the first seam 104-1 to the proximal peripheral surfaces 64, 80, and the second portion 234 may extend from the second seam 104-2 to the distal peripheral surfaces 66, 82. A portion of the upper surface 74 of the upper laminate layer 50, as well as the proximal peripheral surfaces 64, 80 and the distal peripheral surfaces 66, 82, may engage the lower surface 56 of the base layer 48, while the first portion 232 of the upper surface 74 may engage the second portion 234 of the upper surface 74.

In some implementations, the bedrail 18*h* includes a plurality of seams 104-3*h*, 104-4*h*, . . . 104-*nh* disposed between the second seam 104-2 and the proximal portion 60 of the substrate 46. As illustrated in FIG. 12, in some implementations, the bedrail 18*h* may include three seams 104-*nh*. It will be appreciated, however, that the bedrail 18*h* may include more or less than three seams 104-*nh* within the scope of the present disclosure. In forming the hollow distal support 216*h* by folding the substrate 46 in a clockwise direction, as previously described, from the proximal portion 60 to the distal portion 62, a portion of the upper surface 74 of the upper laminate layer 50, and a portion of the lower surface 56 of the substrate 46, may define a multi-sided shape. In this regard, a portion of the upper surface 74 and a portion of the lower surface 56 may each define a portion of a polygon. For example, a portion of the upper surface 74 and a portion of the lower surface 56 may each define a plurality (e.g., three) of sides of a polygon. For example, as illustrated in FIG. 12, a portion of the upper surface 74 and a portion of the lower surface 56 may define a plurality of sides of a hexagon, an octagon, a decagon, or other similar polygon extending between the second seam 104-2 and another of the seams 104-3*n*. In this regard, if the portion of the upper surface 74 and the portion of the lower surface 56 define a plurality of sides of an octagon, the angle defined by adjacent seams of the plurality of seams 104-3*h*, 104-4*h*, . . . 104-*nh* may be substantially equal to ninety degrees. The portion of the upper surface 74 may be substantially parallel to the portion of the lower surface 56. In this regard, depending on the number of seams 104-3*n*, the portion of the upper surface 74 and the portion of the lower surface 56 may define, or otherwise resemble, a segmented arcuate shape (e.g., semi-cylindrical).

Figure 13A:
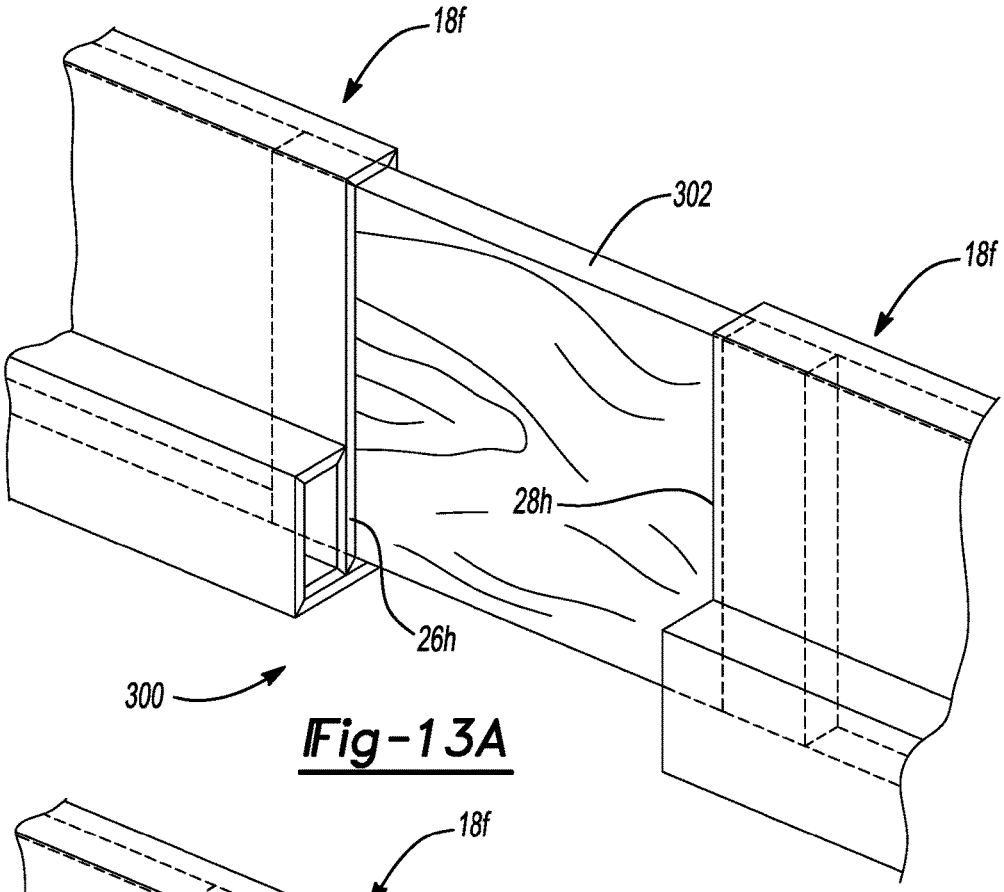
FIG. 13A is a perspective view of a bedrail assembly in a partially assembled state in accordance with the principles of the present disclosure.
Figure 13B:
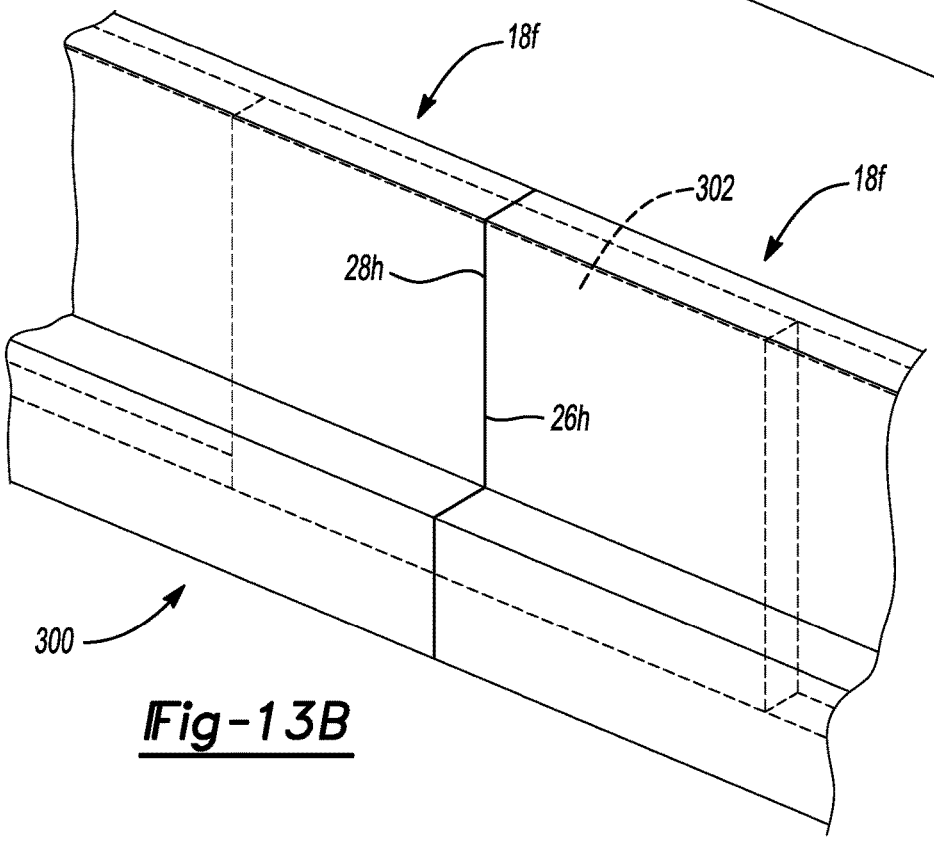
FIG. 13B is a perspective view of the bedrail assembly of FIG. 13A in an assembled state in accordance with the principles of the present disclosure.

With reference to FIGS. 13A and 13B, a bedrail assembly 300 is shown. While article 300 is generally shown and described herein as being a "bedrail assembly 300," it will be appreciated that article 300 may be utilized in various ways within the scope of the present disclosure. For example, the bedrail assembly 300 may be utilized as a "shelf" for use with the furniture unit 10.

The bedrail assembly 300 may include a splice member 302 and one or more of the shelves 18, 18*a*, 18*b*, 18*c*, 18*d*, 18*e* or one or more of the bedrails 18*f*, 18*g*, 18*h*. In this regard, while the bedrail assembly 300 is generally shown and described as including two of the bedrails 18*f*, it will be appreciated that the bedrails 18*f* of the bedrail assembly 300 may be replaced with one or more of the shelves 18, 18*a*, 18*b*, 18*c*, 18*d*, 18*e* or one or more of the bedrails 18*f*, 18*g*, 18*h* within the scope of the present disclosure. Accordingly, while article 300 is generally shown and described herein as being a "bedrail assembly 300" it will be appreciated that article 300 may be utilized in various ways within the scope of the present disclosure. For example, the bedrail assembly 300 may be utilized as a "shelf assembly" for use with the furniture unit 10.

The splice member 302 may be formed from wood, metal, polymer, or other suitable structural material and may define a cross-sectional shape that is substantially the same as a void defined by the shelves 18, 18*a*, 18*b*, 18*c*, 18*d*, 18*e* or the bedrails 18*f*, 18*g*, 18*h*. For example, the cross-sectional shape of the splice member 302 may be substantially the same as the shape of the void defined by the hollow distal support 216*f* of the bedrail 18*f*. In this regard, the void may be defined by the lower surface 56 of the base layer 48. The cross-sectional size of the void defined by the surface 56 of the base layer 48 may be smaller or larger than the cross-sectional size of the splice member 302.

Assembling the bedrail assembly 300 may include placing the splice member 302 within the hollow distal support 216*f* of two bedrails 18*f* (e.g., FIG. 13A) and moving a first of the bedrails 18*f* toward the second of the bedrails 18*f*. For example, assembling the bedrail assembly 300 may include moving a first of the bedrails 18*f* toward the second of the bedrails 18*f* until an end 26*h* of the first of the bedrails 18*f* abuts an end 28*h* of the second of the bedrails 18*f*. If the cross-sectional size of the void defined by the surface 56 of the base layer 48 is smaller than the cross-sectional size of the splice member 302, the splice member 302 may be disposed within the void in a friction-fit arrangement. The splice member 302 can increase the strength and rigidity of the bedrails 18*f* and the bedrail assembly 300.

The configuration of, and related methods of manufacturing, the furniture unit 10 described herein, including, for example, the various channels 202, and the seams 104-*n* and folds 106-*n* formed thereby, can allow a user to easily and efficiently manufacture the shelves 18, 18*a*, 18*b*, 18*c*, 18*d*, 18*e*, the bedrails 18*f*, 18*g*, 18*h*, the furniture unit 10, and the bedrail assembly 300 to have superior strength and durability.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A furniture unit comprising at least one substrate having a base layer and a laminate layer, wherein the base layer has an upper surface, a lower surface opposite the upper surface, a proximal peripheral surface extending from the upper surface to the lower surface, a distal peripheral surface opposite the proximal peripheral surface and extending from the upper surface to the lower surface, a first seam, and a second seam spaced apart from the first seam, the first and second seams extending in a direction parallel to the proximal peripheral surface, wherein the laminate layer is disposed on one of the upper surface or the lower surface and includes a channel exposing a portion of the base layer, and wherein the proximal peripheral surface is disposed within the channel and engages the portion of the base layer such that the substrate defines a first hollow support.

2. The furniture unit of claim 1, wherein the upper surface engages the lower surface.

3. The furniture unit of claim 1, wherein the distal peripheral surface is aligned with a portion of the upper surface.

4. The furniture unit of claim 3, wherein the distal peripheral surface is coplanar with the portion of the upper surface.

5. The furniture unit of claim 1, wherein the distal peripheral surface engages the lower surface such that the substrate defines a second hollow support.

6. The furniture unit of claim 1, wherein the distal peripheral surface is coplanar with the proximal peripheral surface.

7. The furniture unit of claim 1, wherein the distal peripheral surface faces a first direction and the proximal peripheral surface faces a second direction opposite the first direction.

8. The furniture unit of claim 1, wherein the distal peripheral surface faces a first direction and the proximal peripheral surface faces the first direction.

9. The furniture unit of claim 1, wherein a first portion of the upper surface engages a second portion of the upper surface.

10. The furniture unit of claim 9, wherein the first portion of the upper surface is attached to the second portion of the upper surface.

11. The furniture unit of claim 1, wherein the substrate further comprises a third seam spaced apart from the first and second seams, and a fourth seam spaced apart from the first, second, and third seams, the third and fourth seams extending in a direction parallel to the distal peripheral surface, and wherein a portion of the upper surface defines a multi-sided shape extending between at least three of the first, second, third, and fourth seams.

12. The furniture unit of claim 11, wherein the multi-sided shape defines a portion of one of a hexagon, an octagon, or a decagon.

13. The furniture unit of claim 12, wherein the multi-sided shape defines an arc.

14. The furniture unit of claim 11, wherein a portion of the lower surface defines a multi-sided shape extending between at least three of the first, second, third, and fourth seams.

15. The furniture unit of claim 14, wherein the portion of the lower surface is parallel to the portion of the upper surface.

16. The furniture unit of claim 1, further comprising a second substrate defining a second hollow support; and a splice disposed within the first hollow support and the second hollow support.

17. A furniture unit comprising at least one substrate having:

an upper surface;

a lower surface opposite the upper surface;

a proximal peripheral surface extending from the upper surface to the lower surface and engaging the lower surface such that the substrate defines a first hollow support;

a distal peripheral surface opposite the proximal peripheral surface and extending from the upper surface to the lower surface, the distal peripheral surface engaging the lower surface such that the substrate defines a second hollow support;

wherein the first hollow support includes a first seam, a second seam, a third seam, a fourth seam, and a fifth seam, each of the first, second, third, fourth, and fifth seams being spaced apart from the others of the first, second, third, fourth, and fifth seams and extending in a direction parallel to the proximal peripheral surface, and wherein the upper surface includes a first portion, extending from the first seam to the second seam, a second portion extending from the second seam to the third seam, a third portion extending from the third seam to the fourth seam, and a fourth portion extending from the fourth seam to the fifth seam, the first portion and the second portion defining a first angle therebetween, the second portion and the third portion defining a second angle therebetween, and the third portion and the fourth portion defining a third angle therebetween, the third angle being equal to the first angle and the second angle.

18. The furniture unit of claim 17, wherein the proximal peripheral surface engages one of the distal peripheral surface, the upper surface, or the lower surface.

19. The furniture unit of claim 17, wherein the upper surface defines a portion of one of a hexagon, an octagon, or a decagon.

20. The furniture unit of claim 19, wherein the upper surface defines an arc.

21. The furniture unit of claim 17, wherein a portion of the lower surface defines a multi-sided shape extending between at least three of the first, second, third, and fourth seams.

22. The furniture unit of claim 21, wherein the portion of the lower surface is parallel to the portion of the upper surface.

23. The furniture unit of claim 17, wherein the first hollow support includes a sixth seam, the upper surface including a fifth portion extending from the fifth seam to the sixth seam, the fourth portion and the fifth portion defining a fourth angle therebetween, the fourth angle being equal to the first angle, the second angle, and the third angle.

* * * * *